US012808134B2

(12) United States Patent
Menzenbach

(10) Patent No.: US 12,808,134 B2
(45) Date of Patent: Nov. 24, 2026

(54) SELF-PROPELLED ROAD CONSTRUCTION MACHINE

(71) Applicant: Wirtgen GmbH, Windhagen (DE)

(72) Inventor: Christoph Menzenbach, Neustadt (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 19/196,868

(22) Filed: May 2, 2025

(65) Prior Publication Data

US 2025/0347059 A1 Nov. 13, 2025

(30) Foreign Application Priority Data

May 9, 2024 (DE) ..... 10 2024 113 082.2

(51) Int. Cl.
*E01C 19/26* (2006.01)
*E01C 19/00* (2006.01)

(52) U.S. Cl.
CPC ..... *E01C 19/26* (2013.01); *E01C 19/004* (2013.01)

(58) Field of Classification Search
CPC ..... E01C 19/26; E01C 19/004; E01C 21/00; E01C 23/088; B60K 2360/1438;
(Continued)

(56) References Cited

U.S. PATENT DOCUMENTS 11,619,013 B1 4/2023 Mashek et al.
12,312,955 B2 5/2025 Berning et al.
(Continued)

FOREIGN PATENT DOCUMENTS

DE 102005044211 A1 3/2007
DE 102016010390 A1 3/2018
(Continued)

OTHER PUBLICATIONS

USH1845H; Thomas J. Kelly; "Method and apparatus for using a control system of an earthworking machine as a training system"; Mar. 7, 2000 (Year: 2000).*
(Continued)

*Primary Examiner* — James M Mcpherson
*Assistant Examiner* — Leah N Miller
(74) *Attorney, Agent, or Firm* — Gary L. Montle; Lucian Wayne Beavers; Patterson Intellectual Property Law, PC

(57) ABSTRACT

A road construction machine is configured wherein control command signals are generated for drives and actuators assigned to wheels and/or a milling/mixing roller. A state monitoring device detects an operating state or operating mode of the drives and actuators. A plurality of instruction data sets are stored in a memory device, each containing data for an instruction to be visualized using a human-machine interface. In a learning mode comprising a plurality of lessons for adjusting the wheel positions and/or a roller height, depending on the detected operating state or operating mode, a specific data set is selected and the instruction corresponding to the selected instruction data set is visualized using the human-machine interface. Depending on a command entered with the human-machine interface after the visualization of the instruction, control command signals are generated for the drives and actuators corresponding to the command entered, the wheels and/or milling/mixing roller moving accordingly.

20 Claims, 12 Drawing Sheets

(58) Field of Classification Search
CPC ..... B60K 35/10; B60K 2360/166; B60K 2360/175; B60K 35/22; B60Y 2200/41
USPC ..... 701/50
See application file for complete search history.

(56) References Cited

U.S. PATENT DOCUMENTS

| | | | | |
|---|---|---|---|---|
| 2002/0022909 | A1* | 2/2002 | Karem | G05D 1/0094 701/3 |
| 2016/0104391 | A1* | 4/2016 | Wieland | G09B 19/24 434/219 |
| 2018/0202118 | A1 | 7/2018 | Menzenbach et al. | |
| 2022/0048352 | A1 | 2/2022 | Busley et al. | |
| 2023/0031013 | A1* | 2/2023 | Faust | A01D 41/1217 |
| 2023/0326263 | A1 | 10/2023 | Laugwitz | |

FOREIGN PATENT DOCUMENTS

| | | | | |
|---|---|---|---|---|
| DE | 102022124728 | A1 | 3/2023 | |
| DE | 102022108663 | A1 | 10/2023 | |
| EP | 2977514 | A1 | 1/2016 | |
| KR | 102089374 | B1 * | 3/2020 | G06Q 50/2057 |

OTHER PUBLICATIONS

European Extended Search Report for corresponding patent application No. 25172772.3, dated Oct. 13, 2025, 6 pages (not prior art).

* cited by examiner

SELF-PROPELLED ROAD CONSTRUCTION MACHINE

CROSS-REFERENCES TO RELATED APPLICATIONS

This application claims the benefit of German Patent Application No. 10 2024 113 082.2, filed May 9, 2024, and which is hereby incorporated by reference in its entirety.

FIELD OF THE INVENTION

The present disclosure relates to a self-propelled road construction machine comprising a machine frame carried by drivable, steerable wheels or crawler tracks and a milling/mixing roller for working the ground that is arranged on the machine frame and is adjustable in height relative to the surface of the ground to be worked and a plurality of drives and/or actuators associated with the wheels or crawler tracks and the milling/mixing roller for driving and steering the wheels or crawler tracks and adjusting the height of the milling/mixing roller relative to the surface of the ground to be worked.

BACKGROUND

Among the well-known self-propelled road construction machines are road milling machines, which can be used to mill off a road surface. A distinction must be made between road milling machines and stabilizers or recyclers, which, by adding binding agents, create a load-bearing substructure from a non-load-bearing subsoil, for example loose ground (stabilizer) or a damaged road surface (recycler), which is suitable for later construction with a road surface. Road milling machines and stabilizers or recyclers have a milling/mixing roller that is adjustable in height relative to the ground to be worked for milling and mixing the substrate, if necessary with additional binding agent, wherein the milling/mixing roller is arranged on a machine frame that is carried by wheels or crawler tracks. Drives and/or actuators are provided for driving and steering the wheels or crawler tracks as well as for adjusting the height of the milling/mixing roller. In addition, the known road construction machines have a controller to control the drives and/or actuators.

The height of the milling/mixing roller relative to the ground surface can be adjusted by adjusting the height of the milling/mixing roller relative to the machine frame. If the road construction machine is equipped with lifting devices that support the machine frame, the height adjustment of the milling/mixing roller can also be carried out by lifting and lowering the machine frame. The lifting devices also allow the inclination of the machine frame relative to the ground surface to be adjusted.

The drives and actuators of the known road construction machines are generally hydraulic drives and actuators. Hydraulic pumps driven by an internal combustion engine are provided to supply the hydraulic drives and actuators with hydraulic fluid. Alternatively, electric drives can be provided in which the energy can be provided, for example, by a battery or a generator driven by an internal combustion engine.

In addition, the well-known road construction machines have a human-machine interface through which the operator can make contact and communicate with the construction machine. Interaction with the machine can be achieved via various operating elements and display units.

The demands placed on the operation of road construction machinery are becoming ever higher. The operator is required to precisely adjust the position of the wheels or crawler tracks so that the road construction machine moves along a predetermined line, and to precisely adjust the height of the machine frame relative to the ground surface, and to precisely align the machine frame relative to the ground surface. The operator must also be able to precisely adjust the height of the milling/mixing roller relative to the ground surface in order to achieve the desired milling depth.

BRIEF SUMMARY

An object in accordance with the present disclosure may be to provide a self-propelled road construction machine which gives the operator the opportunity to quickly familiarize himself with the construction machine.

Various embodiments of the present disclosure as described below can comprise one or more of the features or combinations of features mentioned below. A feature designated with an indefinite article can also be present more than once if the indefinite article is not to be understood with an explicit reference to a single use. A designation of features with a number word, for example "first and second," does not exclude that the number of these features can be greater than the number indicated by the number word. In the description of all the embodiments, the expression "can" is also to be understood as "preferably" or "expediently."

The road construction machine according to the present disclosure may include a controller which is configured such that control command signals are generated for the drives and/or actuators associated with the wheels or crawler tracks and/or the milling/mixing roller in order to drive and steer the wheels or crawler tracks and to adjust the height of the milling/mixing roller relative to the ground to be worked.

Furthermore, a road construction machine as disclosed herein may include a human-machine interface that interacts with the controller and a memory device that interacts with the controller. The road construction machine further comprises a state monitoring device which interacts with the controller and is configured to detect an operating state and/or an operating mode of the drives and/or actuators. In this context, an operating state is understood to be the current state of a drive or actuator in which the drive or actuator is found, for example whether the drive or actuator is activated or deactivated or at what speed individual parts of the drive or actuator move or what position individual parts of the drive or actuator assume. In this respect, the operating state of the drives or actuators is linked to a specific machine function, for example the adjustment of the height of the milling/mixing roller relative to the ground surface. Consequently, by monitoring the operating state of a height adjustment actuator, the height of the milling/mixing roller can be detected. If the drives or actuators are intended to allow different operating modes, the state monitoring device can also detect these operating modes, for example different steering modes that may be provided by the controller for steering the wheels or crawler tracks. The memory device may comprise a central memory which is a component of a central controller or a plurality of memories which are each part of individual control units.

A road construction machine as disclosed herein may be characterized in that a plurality of instruction data sets is stored in the memory device, each data set containing data for an instruction to be visualized using the human-machine interface. The data sets can be read into the memory device. In this context, an instruction is understood as a prompt to the operator to carry out a specific action, which consists in entering a command to adjust the position of the wheels or crawler tracks and/or the height of the milling/mixing roller relative to the surface of the ground to be worked by means of the human-machine interface. The instruction data sets contain the data with which the instructions can be visualized by means of the human-machine interface.

For visualizing the instruction data sets, the human-machine interface can, for example, have a display screen on which the data sets can be visualized using graphical representations, in particular pictograms or animations. The data of the instruction data sets then contain the data required to display a graphic on the display, for example image data, in order to be able to display a graphic on the display, which prompts the operator to enter a command. The image data can be data in the known formats, for example the PNG format and JPEG format, but also TIFF, GIF etc. Alternatively or additionally, in order to visualize the instructions, the operating elements to be operated can be identified, for example by highlighted lighting, in particular a flashing of the operating element lighting compared to the other operating elements of the construction machine.

In addition to an actual operating mode, the controller of the road construction machine provides a learning mode having a plurality of lessons for the adjustment of the position of the wheels or crawler tracks and/or the height of the milling/mixing roller. In this context, a learning mode is understood to be a mode that is detached from the actual operation of the construction machine, that aims at achieving a specific work result and is intended to allow the operator to learn specific functions of the machine. The learning mode comprises a number of lessons, wherein each lesson can have a specific learning objective, such as adjusting the height of the milling/mixing roller or adjusting the steering angle of the wheels or crawler tracks.

The controller is configured for at least one lesson of the learning mode such that, depending on an operating state and/or operating mode of the drives and/or actuators detected by the state monitoring device, a selection of a specific data set is made from the instruction data sets stored in the memory device, and the instruction corresponding to the selected instruction data set is visualized using the human-machine interface. Consequently, depending on the operating state or operating mode of a drive or actuator, the operator is prompted to enter a specific command to control the machine in order to familiarize himself with a specific machine function that is predetermined by the machine itself.

The controller is further configured such that, depending on the command entered by a person with the human-machine interface after the visualization of the instruction, the control command signals corresponding to the command input are generated for the drives and/or actuators for driving and steering the wheels or crawler tracks and/or adjusting the height of the milling/mixing roller, so that after the command is entered the position of the wheels or crawler tracks and/or the height of the milling/mixing roller is actually changed. This distinguishes the learning mode from a pure simulation. The road construction machine also allows the operator to experience the corresponding reaction of the construction machine to the command input, so that the operator can familiarize himself with a machine function predetermined by the machine depending on the respective operating state or operating mode, thereby enhancing learning success.

An embodiment of the road construction machine as disclosed herein provides that one lesson of the learning mode is the adjustment of the height of the milling/mixing roller relative to the surface of the ground to be worked. For this function of the learning mode, the controller is configured such that, if the height of the milling/mixing roller relative to the ground surface detected by the state monitoring device is less than a predetermined limit value for the height, an instruction data set is selected from the instruction data sets stored in the memory device and the instruction corresponding to the selected instruction data set is visualized using the human-machine interface, which instruction prompts a person to enter a command to lift the milling roller, so that at least one actuator assigned to the milling/mixing roller is actuated such that the milling/mixing roller is lifted. This ensures that the operator can familiarize himself with the height adjustment of the milling/mixing roller under realistic conditions without having to worry about the current position of the milling/mixing roller. The operator can therefore practice the height adjustment without the risk of the milling/mixing roller inadvertently being able to penetrate the ground even on the first attempt.

The controller is further configured such that, if the height of the milling/mixing roller relative to the ground surface detected by the state monitoring device is greater than a predetermined limit value for the height, an instruction data set is selected from the instruction data sets and the instruction corresponding to the selected instruction data set is visualized using the human-machine interface, which instruction prompts a person to enter a command to lower the milling/mixing roller, so that at least one actuator assigned to the milling/mixing roller is actuated such that the milling/mixing roller is lowered. It is assumed that there is still sufficient space left for lowering the milling/mixing roller after the predetermined limit value has been exceeded.

An embodiment provides that the controller for this lesson of the learning mode is configured such that a specific operating range for the height of the milling/mixing roller is defined by a lower minimum limit value for a minimum distance to be maintained from a reference point of the milling/mixing roller to the surface of the ground to be worked and, depending on the command entered by a person for lowering the milling/mixing roller after the visualization of the instruction, the control command signals corresponding to the command entered for the at least one actuator assigned to the milling/mixing roller are only generated when the milling/mixing roller is adjusted in height within the defined operating range, so that the minimum distance to the ground surface is maintained. This ensures that the operator cannot inadvertently drive the milling/mixing roller into the ground after being prompted to lower the milling/mixing roller if the predetermined limit value is exceeded. This further increases security. The operator can thus practice the machine function of adjusting the height of the milling/mixing roller in a realistic manner without any danger.

The controller may be configured such that individual instruction data sets can be selected one after the other depending on an operating state and/or operating mode of the drives and/or actuators detected by the state monitoring device. If a lesson should contain a plurality of instruction data sets, the controller can specify a specific order in which the operator is prompted to enter a specific command.

One embodiment provides that the controller is configured such that, if the height of the milling/mixing roller relative to the ground surface detected by the state monitoring device is less than a limit value for the height, a data set is selected from the data sets of instructions for a preceding instruction and the instruction corresponding to the selected instruction data set is visualized using the human-machine interface, which instruction first prompts a person to enter a command to lift the milling roller, so that after the command is entered at least one actuator assigned to the milling/mixing roller is actuated such that the milling/mixing roller is lifted. Consequently, depending on the height setting of the milling/mixing roller, the operator is only prompted to perform the action that is possible without driving the roller into the ground. Once the operator has lifted the milling/mixing roller, which the operator can also see, the operator is automatically encouraged to perform the next exercise, which is to lower the milling/mixing roller again. For this purpose, the controller is configured such that an instruction data set is selected from the instruction data sets for an instruction following the preceding instruction, and the instruction corresponding to the selected instruction data set is visualized using the human-machine interface, which instruction prompts a person to enter a command to lower the milling/mixing roller, so that at least one actuator assigned to the milling/mixing roller is actuated such that the milling/mixing roller is lowered. However, the operator can only be encouraged to carry out the next exercise if the state monitoring device detects a defined operating state. For example, an animation for lowering the milling/mixing roller can only be displayed if the milling/mixing roller has been lifted by at least a predetermined amount and/or a predetermined height. This provides further feedback into the process.

Consequently, the controller determines a sequence for the visualization of the data sets depending on the operating state, i.e., the milling roller is initially in a lowered position, i.e., first a prompt for a command input to lift the milling/mixing roller and then to lower it. In an analogous manner, the controller may also be configured such that the operator is first prompted to lower and then lift if the milling/mixing roller should initially be, not in a lowered position, but in a lifted position.

For the lesson described above, which comprises two instructions, the controller can again define a specific operating range for the height of the milling/mixing roller by a lower minimum limit value for a minimum distance to be maintained from a reference point of the milling/mixing roller to the surface of the ground to be worked and, depending on the command entered by a person for lowering the milling/mixing roller after the visualization of the instruction, can only generate the control command signals corresponding to the command entered for the at least one actuator assigned to the milling/mixing roller when the milling/mixing roller is adjusted in height within the defined operating range, so that the minimum distance to the ground surface is maintained.

The embodiments described above are to be understood only as an exemplary embodiment for a plurality of consecutive instructions. A lesson may include not only two, but also a plurality of consecutive instructions that can be selected to be called up in a specific order depending on different operating states or operating modes of the road construction machine.

A further embodiment of the road construction machine as disclosed herein has a machine frame which is carried by lifting devices on the left in the working direction, which devices are assigned to left wheels or crawler tracks, and by lifting devices on the right in the working direction, which devices are assigned to right wheels or crawler tracks. Actuators are provided to operate the left and right lifting devices in order to be able to adjust the height and/or inclination of the machine frame and the milling/mixing roller arranged on the machine frame relative to the surface of the ground to be worked by actuating the actuators assigned to the lifting devices.

The learning mode for this embodiment provides a lesson to practice adjusting the height or transverse inclination of the machine frame. For the lesson of adjusting the height of the machine frame, the controller may be configured such that, if the height of the height-adjustable milling/mixing roller relative to the ground surface detected by the state monitoring device is less than a predetermined limit value for the height, an instruction data set is selected from the instruction data sets stored in the memory device and the instruction corresponding to the selected instruction data set is visualized using the human-machine interface, which instruction prompts a person to enter a command to lift the machine frame, so that after the command is entered the actuators assigned to the lifting devices are actuated such that the machine frame is lifted. The operator can therefore adjust the height without the milling/mixing roller being able to penetrate the ground.

When adjusting the height of the lifting devices assigned to the wheels or chains, in addition to the position of the height-adjustable milling/mixing roller above the ground surface, the height of the milling roller housing surrounding the milling roller above the ground surface must also be taken into account.

In the event that the height of the height-adjustable milling/mixing roller relative to the ground surface detected by the state monitoring device is greater than a predetermined limit value for the height, the controller may be configured such that an instruction data set is selected from the instruction data sets and the instruction corresponding to the selected instruction data set is visualized using the human-machine interface, which instruction prompts a person to enter a command to lower the machine frame, so that after the command is entered the actuators assigned to the lifting devices are actuated such that the machine frame is lowered. There is no need to worry that the milling/mixing roller will immediately penetrate the ground, as the height of the milling/mixing roller is greater than a predetermined limit value. However, in analogy to the direct height adjustment of the milling/mixing roller, this can be excluded by defining a specific operating range for the height of the milling/mixing roller by a lower minimum limit value for a minimum distance to be maintained from a reference point of the milling/mixing roller to the surface of the ground to be worked and, depending on the command input made by a person after the visualization of the instruction, the control command signals corresponding to the command input for the actuators assigned to the lifting devices are only generated when the milling/mixing roller is adjusted in height within the defined operating range, so that the minimum distance to the ground surface is maintained.

While adjusting the height of the machine frame only poses the risk of the milling/mixing roller inadvertently penetrating the ground, improper adjustment of the inclination of the construction machine can still lead to stability problems. In the worst case, the construction machine can tip over. Without an appropriate safety system, this could happen if the construction machine is tilted to the wrong side just before the tipping point due to incorrect operation of the operating element. Therefore, the operator should be able to familiarize himself with the inclination adjustment in particular.

To avoid stability problems when learning the height setting, a further embodiment provides that the state monitoring device is configured such that the transverse inclination of the machine frame, in particular the transverse inclination relative to the surface of the ground to be worked, or the transverse inclination relative to the horizontal is also detected. The transverse inclination of the machine frame relative to the horizontal can be detected by means of an inclination sensor of the state monitoring device; the transverse inclination of the machine frame relative to the ground can be determined by the state monitoring device by detecting the operating state of the lifting devices, in particular by comparing the lifting state of the individual lifting devices to one another. The controller is configured for this lesson of the learning mode such that, if the transverse inclination of the machine frame detected by the state monitoring device is an inclination to the right side, an instruction data set is selected from the instruction data sets stored in the memory device depending on the transverse inclination and the instruction corresponding to the selected instruction data set is visualized with the human-machine interface, which instruction prompts a person to enter a command to roll the machine frame to the left side of the road milling machine in the working direction, so that after the command is entered the actuators assigned to the lifting devices on the left in the working direction are actuated such that the machine frame is lowered on the left side, and/or the actuators assigned to the lifting devices on the right in the working direction are actuated such that the machine frame is lifted on the right side. If the operator follows this instruction, the operator will not operate the operating element to roll to the right side, which would lead to instability of the road construction machine.

In the event that the transverse inclination of the machine frame detected by the state monitoring device is an inclination to the left side, the controller selects an instruction data set from the instruction data sets and visualizes the instruction corresponding to the selected instruction data set with the human-machine interface, which instruction prompts a person to enter a command to roll the machine frame to the right side of the road milling machine in the working direction, so that after the command is entered the actuators assigned to the lifting devices on the right in the working direction are actuated such that the machine frame is lowered on the right side, and/or the actuators assigned to the lifting devices on the left in the working direction are actuated such that the machine frame is lifted on the left side.

Consequently, in the lesson "Adjusting the transverse inclination of the machine frame," by detecting the machine inclination via the state monitoring device and by taking only one specific action depending on the respective operating state of the actuators concerned, the risk of instability is reduced. When adjusting the inclination, a specific order can also be specified. For example, depending on the initial position of the lifting devices or the machine frame, the operator may first be prompted to roll the machine to one side and then to the other side.

When adjusting the transverse inclination of the machine frame, there is always a risk that the milling/mixing roller will inadvertently penetrate the ground or that the milling roller housing will collide with the ground. The controller may therefore also be configured for this lesson of the learning mode such that a specific operating range for the height of the milling/mixing roller is defined by a lower minimum limit value for a minimum distance to be maintained from a reference point of the milling/mixing roller to the surface of the ground to be worked and, depending on the command input made by a person after the visualization of the instruction, the control command signals corresponding to the command input for the actuators assigned to the lifting devices are only generated when the milling/mixing roller is adjusted in height within the defined operating range, so that the minimum distance to the ground surface is maintained.

The controller may also be configured such that a specific operating range for the transverse inclination of the machine frame is defined by a limit value for a maximum inclination and, depending on the command input made by a person after the visualization of the instruction, the control command signals corresponding to the command input for the actuators assigned to the lifting devices are only generated when the machine frame is tilted within the defined operating range, so that the maximum inclination is not exceeded.

Before carrying out an exercise involving the modification of the transverse inclination of the machine frame, it may also be necessary to ask the operator to first bring the machine frame into a stable starting position, in particular a horizontal position or a position parallel to the ground, so that the operator can then roll the machine frame without any danger to one side or the other. In the event that the transverse inclination of the machine frame detected by the state monitoring device is an inclination to the left or right side, i.e., the machine frame is not aligned horizontally or parallel to the ground, the controller can select an instruction data set from the instruction data sets and visualize the instruction corresponding to the selected instruction data set with the human-machine interface, which instruction prompts a person to enter a command to roll the machine frame to the right or left side of the road milling machine in the working direction, so that after the command is entered the actuators assigned to the lifting devices on the right in the working direction are actuated until the machine frame has moved into a horizontal or ground-parallel position, and/or the actuators assigned to the lifting devices on the left in the working direction are actuated until the machine frame has moved into a horizontal or ground-parallel position.

While the lessons of the learning mode described above concern the adjustment of the height and inclination of the machine frame, a lesson of the learning mode may also be the steering of the wheels or tracks, wherein the controller for this lesson of the learning mode may be configured such that, if the position of the wheels or crawler tracks detected by the state monitoring device is a position of the wheels or crawler tracks turned to the right, an instruction data set is selected from the instruction data sets stored in the memory device and the instruction corresponding to the selected instruction data set is visualized using the human-machine interface, which instruction prompts a person to enter a command to steer the front wheels or crawler tracks to the left in the working direction, so that after the command is entered the actuators assigned to the wheels or crawler tracks are actuated such that the wheels turn to the left. Consequently, depending on the operating status of the relevant actuators, the operator will only be prompted to perform the exercise that seems appropriate for the current position of the wheels.

In the event that the position of the wheels or tracked units detected by the state monitoring device is a position of the wheels or tracked units turned to the left, a data set is selected from the instruction data sets stored by the memory device and the instruction corresponding to the selected instruction data set is visualized using the human-machine interface, which instruction prompts a person to enter a command to steer the front wheels or crawler tracks to the right in the working direction, so that after the command is entered the actuators assigned to the wheels or crawler tracks are actuated such that the wheels turn to the right.

An alternative embodiment provides that, in order to learn to steer, the wheels or crawler tracks should first be brought into a straight-ahead position. The controller is therefore configured such that, if the position of the wheels or crawler tracks detected by the state monitoring device is a position turned to the right or left, an instruction data set is selected from the instruction data sets and the instruction corresponding to the selected instruction data set is visualized using the human-machine interface, which instruction prompts a person to position the front wheels straight ahead in the working direction, so that after the command is entered the actuators assigned to the front wheels or crawler tracks are actuated such that the front wheels are positioned straight ahead in the working direction. The controller can place this instruction ahead of other instructions in the sequence, for example those relating to the height adjustment of the milling or mixing roller or the machine frame, in order to first bring the road construction machine into a stable starting position for the individual exercises.

The road construction machine may have two front wheels or crawler tracks in the working direction and two rear wheels or crawler tracks in the working direction, wherein the controller provides for the setting of different steering modes and the state monitoring device is configured such that the position of the front and rear wheels or crawler tracks and the set steering mode are detected. In the learning mode, the road construction machine allows the operator to be prompted to perform specific steering movements depending on the set steering mode.

The controller may be configured such that, if the steering mode detected by the state monitoring device is steering only of the front wheels or crawler tracks, an instruction data set is selected from the instruction data sets and the instruction corresponding to the selected instruction data set is visualized using the human-machine interface, which instruction prompts a person to steer only the front wheels or crawler tracks, so that after the command is entered the actuators assigned to the front wheels or crawler tracks are actuated such that only the front wheels or crawler tracks are steered. It should be noted that the road construction machine may have a different operating element or a different position of an operating element for steering the front wheels or crawler tracks than for steering the rear wheels or crawler tracks. The road construction machine therefore shows the operator the correct operating element and its correct operation.

In the event that the steering mode detected by the state monitoring device is steering both the front and rear wheels or crawler tracks in the same direction or in opposite directions, an instruction data set is selected from the instruction data sets and the instruction corresponding to the selected instruction data set is visualized using the human-machine interface, which instruction prompts a person to steer both the front and rear wheels or crawler tracks in the same direction or in opposite directions, so that after the command is entered the actuators assigned to the wheels or crawler tracks are actuated such that the front and rear wheels or crawler tracks are steered in the same direction or in opposite directions.

If the steering mode detected by the state monitoring device is steering of the front and rear wheels or crawler tracks independently of one another, an instruction data set is selected from the instruction data sets and the instruction corresponding to the selected instruction data set is visualized using the human-machine interface, which instruction prompts a person to steer the front and rear wheels or crawler tracks independently of one another, so that after the command is entered the actuators assigned to the front or rear wheels or crawler tracks are actuated such that the front and rear wheels or crawler tracks are steered independently of one another. These instructions can include two prompts to the operator that are to be visualized, wherein the one prompt can be to operate a first operating element and the other prompt can be to operate a second operating element or can be the prompt to move an operating element into different positions in order to be able to steer the front and rear drives independently of one another.

The drives and/or actuators for the steerable wheels or crawler tracks and the height adjustment of the machine frame or the milling/mixing roller can be hydraulic drives or actuators, for example hydraulic engines operated with hydraulic fluid or piston-cylinder arrangements. The road construction machine may have a central drive device which can comprise a drive engine, in particular an internal combustion engine, and the construction machine may have at least one hydraulic pump and at least one pump distribution gear for supplying the drives and/or actuators with hydraulic fluid.

One embodiment provides that the state monitoring device is configured such that the operation of the drive device is detected, i.e., it is determined whether the drives and/or actuators are supplied with hydraulic fluid. In this embodiment, the controller may be configured such that a selection of a specific instruction data set from the instruction data sets is only made and the instruction corresponding to the selected instruction data set is only visualized using the human-machine interface if the state monitoring device detects the operation of the drive engine. This ensures that the operator is only prompted to enter a command if the relevant drives and/or actuators are actually operated after the command is entered in order to carry out the corresponding machine function.

If, however, the state monitoring device does not detect the operation of the drive engine, the controller can select an instruction data set from the instruction data sets and visualize the instruction corresponding to the selected instruction data set using the human-machine interface, which instruction prompts a person to enter a command to switch on the drive engine or the drive device, in particular the internal combustion engine, so that the operator first switches on the drive engine before a specific machine function is carried out.

The human-machine interface may comprise one or more mechanical or electrical controls that can assume different operating positions and/or a plurality of displays in a wide variety of embodiments. Operating elements can be joysticks, steering wheels, pedals, switches, buttons or the like. Indicators can be displays, light panels, signal lamps or the like. The human-machine interface may also be or comprise a touch-sensitive screen (touchscreen).

The human-machine interface may have an operating element for entering commands for adjusting the height of the milling/mixing roller relative to the machine frame, which operating element is designed such that the operating element can assume a neutral position, a first position and a second position, wherein the controller is designed such that no control command signal is generated for the at least one actuator assigned to the milling/mixing roller, so that the milling/mixing roller remains in the currently set position when the operating element is in the neutral position. The controller may further be designed such that a control command signal is generated for the at least one actuator assigned to the milling/mixing roller, so that the milling/mixing roller is lifted when the operating element is in the first position, and a control command signal is generated for the at least one actuator assigned to the milling/mixing roller, so that the milling/mixing roller is lowered when the operating element is in the second position. With such an operating element, the visualization of the instructions on the display can be done by means of a graphic representation (pictogram) that shows the operator how to operate the operating element in order to carry out the desired machine function.

To provide commands for steering only the front wheels or crawler tracks, the front and rear wheels or crawler tracks in the same direction, or the front and rear wheels or crawler tracks in opposite directions, the human-machine interface may comprise an operating element designed as a steering wheel. For steering the front and rear wheels or crawler tracks independently of one another, the human-machine interface may comprise an operating element designed as a steering wheel for steering the front wheels or crawler tracks and an operating element designed as a joystick for steering the rear wheels or crawler tracks.

Completed lessons can be stored in order to be able to check whether a particular lesson has already been offered. In particular with the steering modes, the machine can "remember" which steering mode has already been taught and then offer the remaining steering modes as the next lesson.

After completing a lesson, the road construction machine should be in a safe operating state in order to be prepared for an upcoming work assignment. Therefore, some or all of the lessons for practicing the machine functions can be designed so that the road construction machine is in a safe operating state at the end of the respective lesson and/or the actual lessons for practicing the machine functions can be followed by instructions for the operator to bring the road construction machine into a safe operating state.

In order to bring the road construction machine into a safe operating state, the operator may be prompted to adjust the transverse inclination of the machine frame using the lifting devices such that the construction machine is aligned as horizontally or as parallel to the ground as possible. In addition, the operator may be prompted to adjust the height of the machine frame using the lifting devices such that the distance between the milling/mixing roller or the milling roller housing and the ground is sufficient enough that the construction machine can start moving immediately.

Some or all of the lessons for practicing machine functions can also be set up so that at the end of the lesson the road construction machine is prepared for a particular job, or the actual lessons for practicing can be followed by instructions for preparing the construction machine for a particular job. For example, in preparation for a particular job, the operator may be prompted to select a specific steering mode, such as a steering mode in which the front and rear wheels steer in opposite directions.

DETAILED DESCRIPTION

Figure 1:
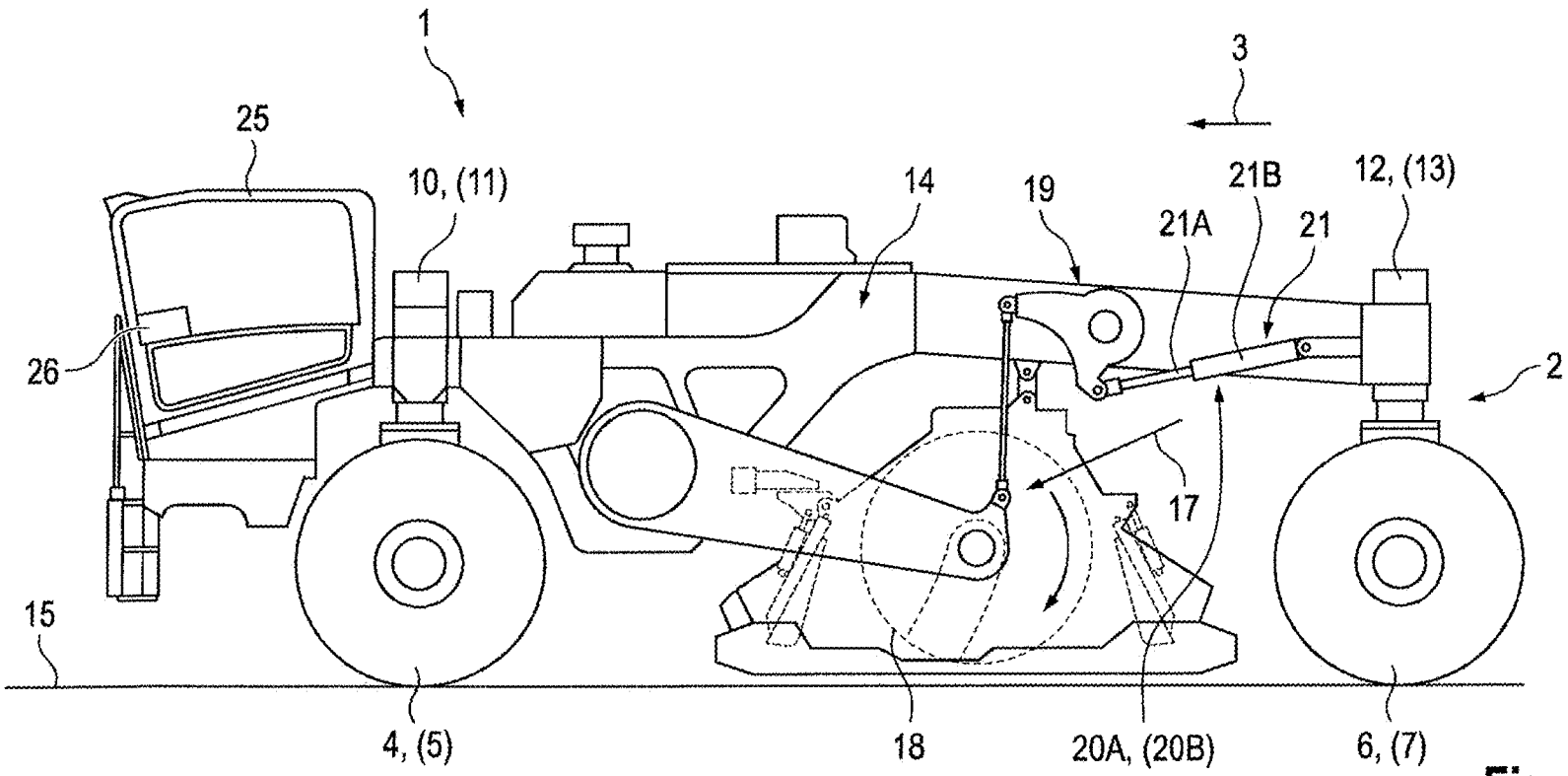
FIG. 1 is a side view of an exemplary embodiment of a self-propelled road construction machine as disclosed herein.
Figure 2:
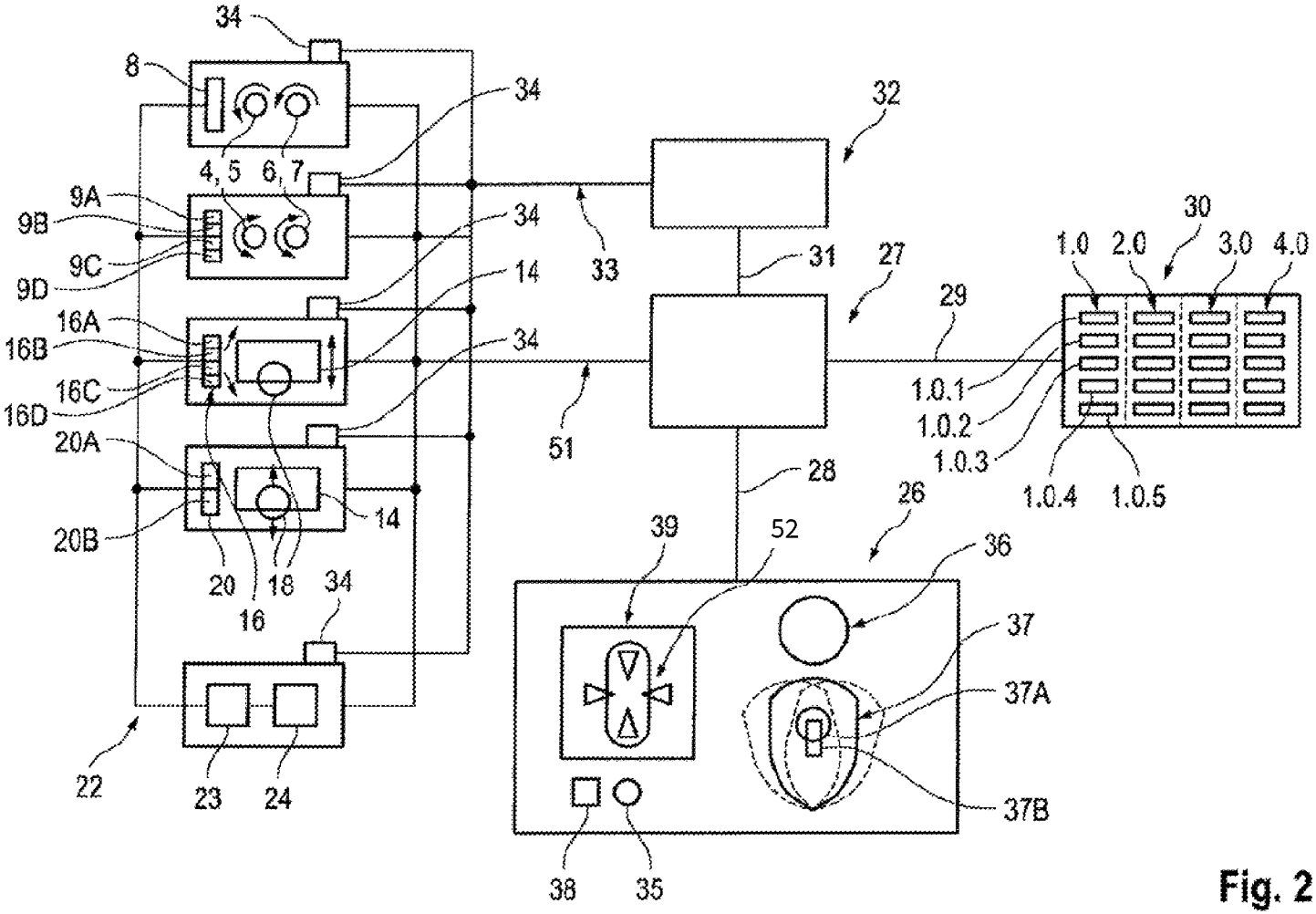
FIG. 2 is a diagram illustrating the functionality of the controller for visualizing instructions depending on the operating state and operating mode of drives and actuators of the road construction machine.

FIG. 1 shows a recycler in side view as an example of a self-propelled road construction machine 1. The recycler is described in detail in EP 2 977 514 B1. FIG. 2 shows a diagram illustrating the individual components and machine functions of the road construction machine.

The road construction machine has a chassis 2 comprising two front wheels 4, 5 and two rear wheels 6, 7 in the working direction 3. The wheels are each driven by a drive (not shown in FIG. 1), for example a hydraulic engine. On the recycler, both the front and rear wheels 4, 5 and 6, 7 are steerable. Steering is carried out by actuators assigned to the wheels (not shown in FIG. 1). FIG. 2 shows the drives 8 for driving the wheels and the actuators 9A, 9B for steering the front wheels 4, 5 and the actuators 9C, 9D for steering the rear wheels 6, 7 in a highly simplified schematic representation. The actuators for steering the wheels can be piston/cylinder arrangements.

Lifting devices 10, 11, 12, 13 are respectively attached to the wheels 4, 5, 6, 7 and support a machine frame 14, so that the machine frame 14 can be adjusted in height and/or inclination relative to the surface 15 of the ground to be worked by retracting or extending the lifting devices. The lifting devices comprise actuators 16 (not shown in FIG. 1), which are hydraulically operated piston-cylinder arrangements. FIG. 2 shows the actuators 16A, 16B of the lifting devices 10, 12 on the left in working direction 3 and the actuators 16C, 16D of the lifting devices 11, 13 on the right in working direction 3 in a highly simplified schematic representation.

A roller housing 17—which is open at the bottom and forms a milling/mixing chamber and in which a milling/mixing roller 18 is located—is arranged between the wheels 4, 5, 6, 7 on the machine frame. To adjust the height of the milling/mixing roller 18 relative to the machine frame 14 (milling depth), a height adjustment device 19 is provided with actuators 20, which, in the present exemplary embodiment, comprises hydraulically operated piston-cylinder arrangements 21 arranged as actuators 20A, 20B on both sides of the machine frame 14, each with a piston 21A and a cylinder 21B. FIG. 2 shows the actuators 20A, 20B of the height adjustment device 19 in a highly simplified schematic representation. By actuating the pistons 21A of the piston-cylinder arrangements 21, the height of the milling/mixing roller 18 can be adjusted in height relative to the machine frame 14 or the ground surface 15, wherein the axis of the milling/mixing roller 18 moves on a circular path. Alternatively or additionally, it is also possible to adjust the height of the milling/mixing roller 18 relative to the ground surface 15 by retracting or extending the lifting devices 10, 11, 12, 13.

The drives 8 and actuators 9A, 9B, 9C, 9D or 16A, 16B, 16C, 16D or 20A, 20B for driving and steering the wheels 4, 5, 6, 7 and the height adjustment of the machine frame 14 or the milling/mixing roller 18 are supplied with hydraulic fluid via hydraulic lines 22, which fluid is provided by at least one hydraulic pump 23, which is driven by an internal combustion engine 24 (FIG. 2).

The operator's cab 25 is located on the machine frame 14, where a human-machine interface 26 is provided for the operating personnel.

The road construction machine has a controller 27 which is configured such that control command signals are generated for the drives 8 or actuators 9A, 9B, 9C, 9D or 16A, 16B, 16C, 16D or 20A, 20B respectively assigned to the wheels 4, 5, 6, 7, the lifting devices 10, 11, 12, 13 and the height adjustment device 19 and control command signals for the internal combustion engine 24 as well as other components of the road construction machine (not shown). The controller 27 can comprise a plurality of control units, one control unit or a plurality of control units of which can be a component of a central controller (not shown) of the construction machine. The controller can have, for example, a general processor, a digital signal processor (DSP) for continuously processing digital signals, a microprocessor, an application-specific integrated circuit (ASIC), an integrated circuit consisting of logic elements (FPGA), or other integrated circuits (IC) or hardware components in order to carry out the control of the drives and actuators. A data processing program (software) can run on the hardware components.

The controller 27 is connected to the human-machine interface 26 via a data line 28 and to a memory device 30 via a data line 29, so that the controller can read data from the memory device. However, the memory device 30 can also be a component of the controller. In addition, the controller 27 is connected via a data line 31 to a state monitoring device 32, which can, however, also be a component of the controller 27 or a central control device. The control command signals of the controller 27 for the drives or actuators are transmitted via data lines 51

The state monitoring device 32 is connected via data lines 33 to the drives 8 and actuators 9A, 9B, 9C, 9D or 16A, 16B, 16C, 16D or 20A, 20B as well as to sensors 34 assigned to the internal combustion engine 24, which sensors monitor the operating state or operating mode of the drives and actuators as well as the combustion engine. Monitoring using individual sensors is only an exemplary embodiment to illustrate the functionality. The operating status and operating mode can also be read from a central control system of the road construction machine.

The state monitoring device 32 detects the operating state of the internal combustion engine 24, i.e., whether the engine is on or off, the rotation of the wheels 4, 5, 6, 7 via the wheel drives 8, the steering angle via the wheel actuators 9A, 9B, 9C, 9D, the height of the milling/mixing roller 18 relative to the machine frame 14 or the ground surface 15 via the actuators 20A, 20B of the height adjustment device, and the height and inclination of the machine frame 14 or the milling/mixing roller 18 relative to the ground surface 15 via the actuators 16A, 16B, 16C, 16D of the lifting devices 10, 11, 12, 13.

The human-machine interface 26 comprises a plurality of operating elements, of which in FIG. 2 are shown only one operating element 35, designed for example as a button or switch, for switching the internal combustion engine 24 on and off, an operating element 36 designed as a steering wheel for steering the front wheels 4, 5, an operating element 37 designed as a joystick for adjusting the height and inclination of the machine frame 14 relative to the ground surface 15 and the height of the milling/mixing roller 18 relative to the machine frame 14 as well as for steering the rear wheels 6, 7 and an operating element 38, designed for example as a button or switch, for activating a learning mode, which will be described in more detail below.

In addition, the human-machine interface 26 comprises a display 39 on which images, graphics, animations or alphanumeric characters 52 can be shown, for example an illustration of the operating element to be operated with an animation of how the operating element is to be operated in order to enter a command. Instead of an exact image of the respective operating element, graphic representations, such as pictograms, can also be shown on the display 39 in order to visualize specific instructions, which are intended to prompt the operator to enter a specific command.

Figure 3:
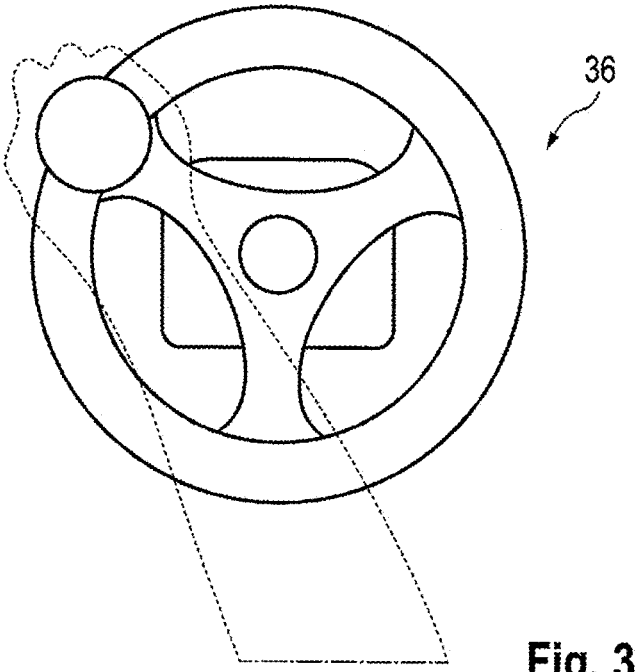
FIG. 3 shows an exemplary embodiment of an operating element of the human-machine interface of the road construction machine designed as a steering wheel for steering the wheels.
Figure 4:
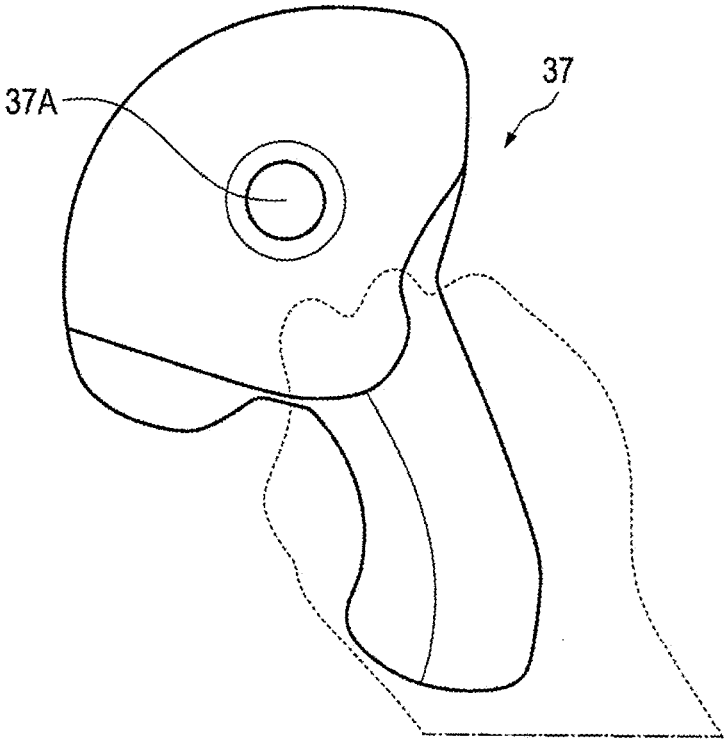
FIG. 4 shows an exemplary embodiment of an operating element formed as a joystick of the human-machine interface of the road construction machine for adjusting the height of the milling/mixing roller and the height and inclination of the machine frame relative to the ground surface.
Figure 5:
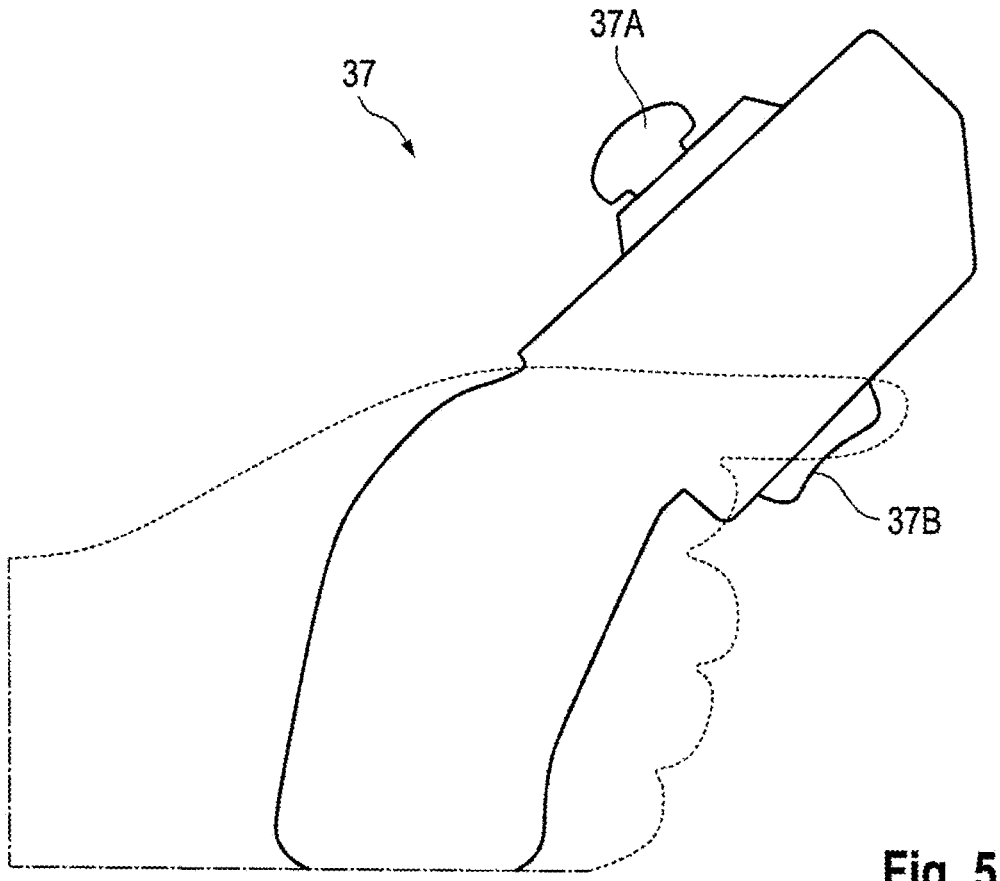
FIG. 5 shows the operating element of FIG. 4 in side view.

FIG. 3 shows the steering wheel 36 in plan view, and FIGS. 4 and 5 show the joystick 37 in plan view (FIG. 4) and in side view (FIG. 5). The steering wheel 36 can be used to steer the front and rear wheels 4, 5 of the road milling machine, wherein a first steering mode, in which only the front wheels 4, 5 steer (front wheel steering), a second steering mode, in which the front and rear wheels 4, 5, 6, 7 steer in opposite directions (front wheel and rear wheel steering in opposite directions), and a third steering mode, in which the front and rear wheels 4, 5, 6, 7 steer in the same direction (front wheel and rear wheel steering in opposite directions "crab steering") can be predetermined. The joystick 37 can be pivoted left or right to steer only the rear wheels 6, 7. FIG. 4 shows the joystick 37 in the position pivoted to the left. Consequently, in a fourth steering mode, by turning the steering wheel 36 the front wheels 4, 5 (in the "front wheel steering" steering mode) can be steered independently of one another, and by pivoting the joystick 37 the rear wheels 6, 7 can be steered independently of one another.

To adjust the height and inclination of the machine frame 14 relative to the ground surface 15, the joystick 37 has an operating button 37A on the top, which can assume a neutral position and can be tilted in four directions: up and down and to the left or right (FIG. 4). By tilting the operating button 37A forward, all lifting devices 10, 11, 12, 13 are extended so that the machine frame 14 is lifted, and by tilting the control button 37A back, all lifting devices 10, 11, 12, 13 are retracted so that the machine frame 14 is lowered. By tilting the operating button 37A to the left, the lifting devices 10, 12 on the left in the working direction 3 are retracted and/or the lifting devices 11, 13 on the right in the working direction are extended, so that the machine frame 14 tilts to the left side, and by tilting the control button 37A to the right, the lifting devices 10, 12 on the left in the working direction are extended and/or the lifting devices 11, 13 on the right in the working direction are retracted, so that the machine frame tilts to the right side. In the neutral position, the lifting devices 10, 11, 12, 13 are not moved.

To adjust the height of the milling/mixing roller 18 relative to the machine frame 14, a toggle switch 37B is provided on the underside of the joystick (FIG. 5), which can assume a neutral position and can be tilted forward or back. By tilting the toggle switch 37B forward, the milling/mixing roller 18 is lifted, and by tilting it backward it is lowered. In the neutral position, the milling/mixing roller 18 is not moved.

Figure 6:
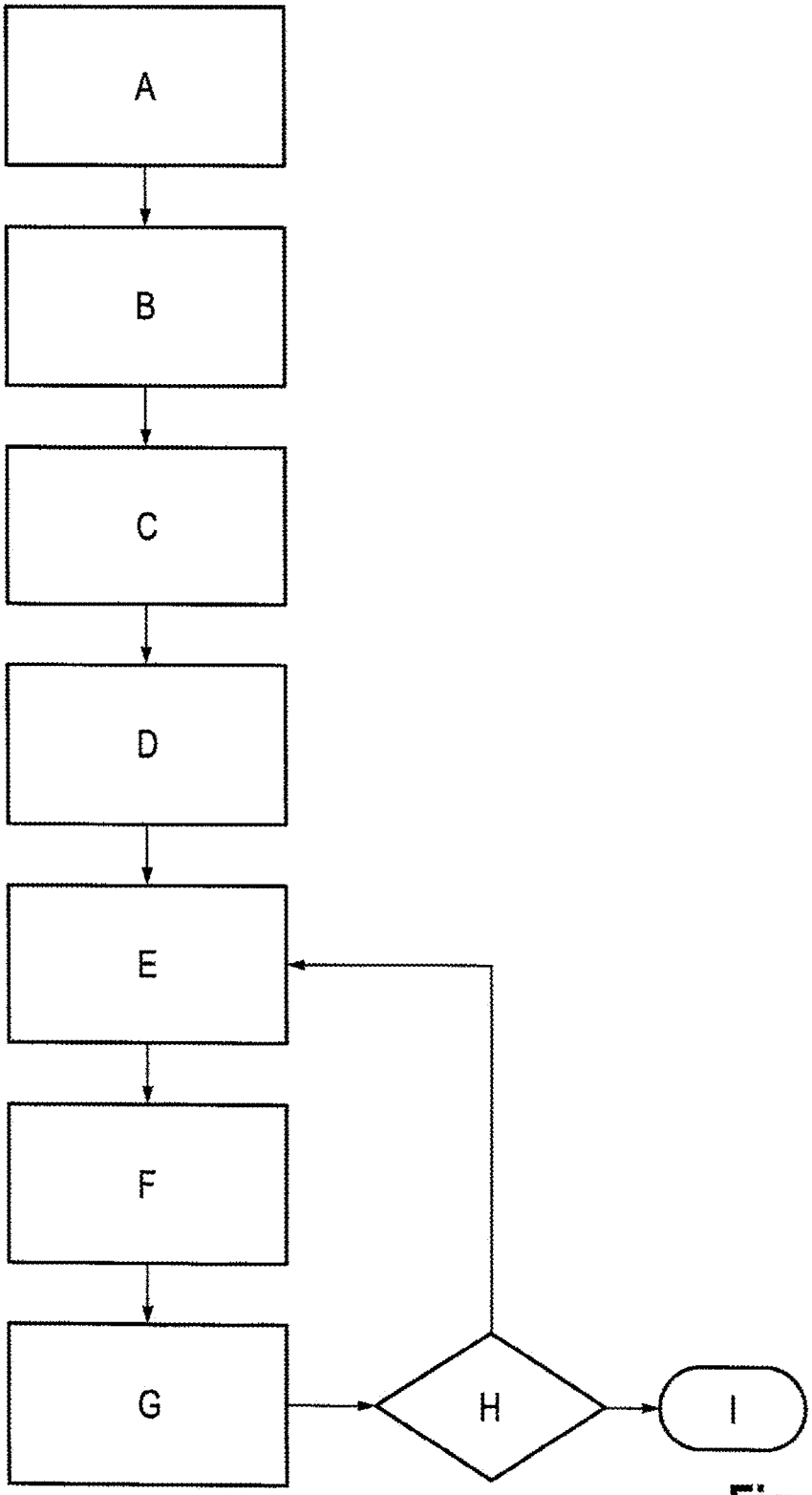
FIG. 6 is a flow chart illustrating the learning mode of the road construction machine.

The learning mode of the road construction machine is described in detail below. FIG. 6 shows a flow chart to illustrate the learning mode. The controller 27 is configured such that the steps shown in FIG. 6 are carried out.

By pressing the button or switch 38 of the human-machine interface, the operator can switch the road construction machine into a learning mode, which is recognized by the controller 27 (step A: "Start learning mode"). For safety reasons, the controller 27 may be configured such that the actuators 8 for driving the wheels 4, 5, 6, 7 are deactivated—for example they are not supplied with hydraulic fluid—so that the construction machine cannot start moving, which can be detected by the monitoring apparatus 32.

The learning mode includes a plurality of lessons. In the present exemplary embodiment, the learning mode comprises a first lesson 1.0 for learning how to adjust the height of the milling/mixing roller 18 relative to the machine frame 14, a second lesson 2.0 for learning how to adjust the height of the machine frame 14 relative to the ground surface 15, a third lesson 3.0 for rolling the machine frame 14, and a fourth lesson 4.0 for steering the wheels 4, 5, 6, 7. Each lesson 1.0, 2.0, 3.0, 4.0 comprises a plurality of instruction data sets 1.0.1, 1.0.2, 1.0.3 . . . , which are stored in the memory device 30. The schematic representation in FIG. 2 shows the four lessons 1.0, 2.0, 3.0, 4.0 as examples, each of which comprises a plurality of instruction data sets 1.0.1, 1.0.2, 1.0.3 . . . . Each instruction data set 1.0.1, 1.0.2, 1.0.3 . . . contains data for an instruction for the operator to enter a command to be visualized using the human-machine interface 26.

The operator is offered the aforementioned lessons 1.0, 2.0, 3.0, 4.0, for example icon graphic icons shown on the display 39, from which the operator can select a lesson, for example the first lesson 1.0 for learning the height adjustment of the milling-mixing roller 18, which is described below with reference to FIG. 7A to 7C (Step B: "Select lesson").

After selecting the lesson "Height adjustment of the milling roller," the controller 26 first reads out those data sets that are assigned to lesson 1.0 from the instruction data sets 1.0.1, 1.0.2, 1.0.3 . . . stored in the memory device 30 (step C: "Reading out the data sets from the memory device") and the controller determines the operating states or operating modes relevant to the lesson that are to be assigned to the data sets (step D: "Determining relevant operating states or operating modes").

The controller 27 then determines the current operating states for the relevant operating states or operating modes (step E: "Determining the current operating states or operating modes") by evaluating the data (signals) of the sensors 34 assigned to the relevant drives 8 or actuators 9A, 9B, 9C, 9D or 16A, 16B, 16C, 16D or 20A, 20B.

Depending on the current operating states or operating modes, the individual instruction data sets 1.0.1, 1.0.2, 1.0.3 . . . are processed by the controller 27 in order to visualize the instructions on the display 39. Depending on the current operating state or operating mode, the controller selects a specific instruction data set (prompt to enter a specific command) (step F. "Selecting a specific data set"). This data set is then visualized on the display 39 (step G: Visualization of the data set").

It is then checked whether all data records have been processed (step H: "Data record processed?"). If this is not the case, the current operating state or operating mode is determined again (step E: "Determining the current operating states or operating modes"), a specific instruction data set is selected depending on the current operating state or operating mode (step F: "Selecting a specific data set") and this data set is then visualized on the display 39 (step G: Visualizing the data set").

The selection of a specific data set and its visualization continues until all data sets have been processed (step: H "Data set processed?"). When all data records have been processed, the lesson is finished (Step I: "End").

Figure 7A:
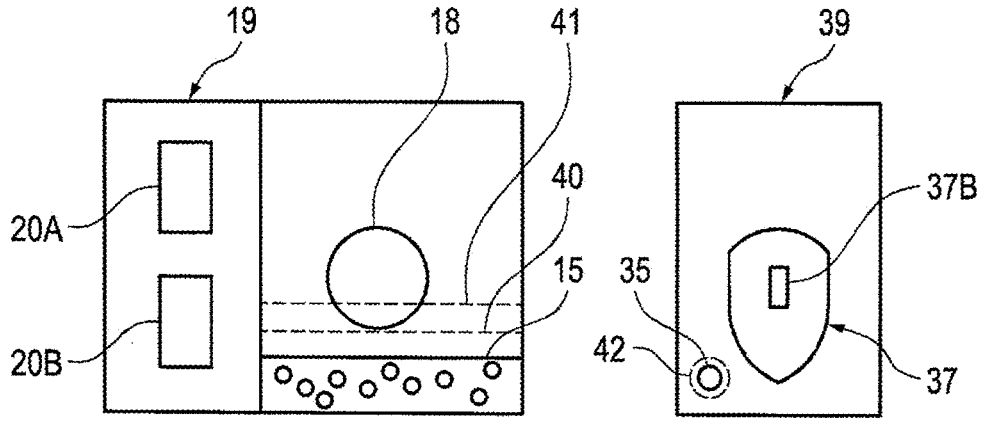
FIG. 7A is a diagram illustrating the visualization of a first instruction for adjusting the height of the milling/mixing roller relative to the ground surface.
Figure 7B:
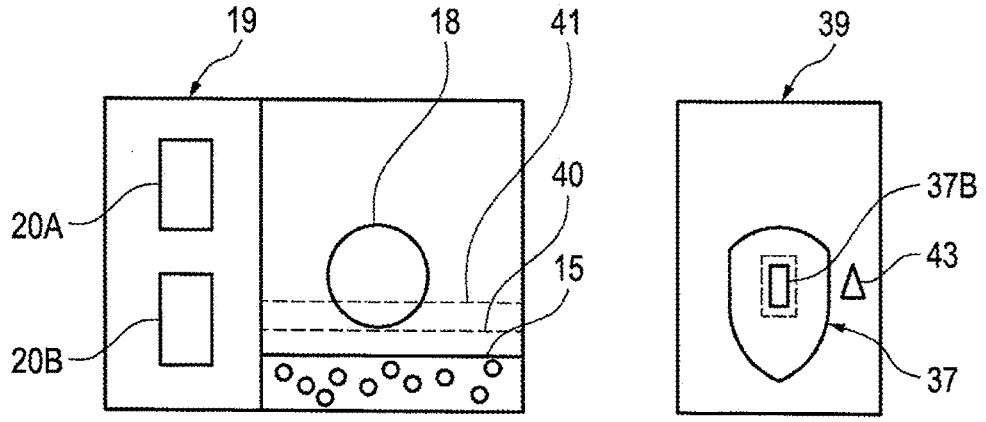
FIG. 7B is a diagram illustrating the visualization of a second instruction for adjusting the height of the milling/mixing roller relative to the ground surface.
Figure 7C:
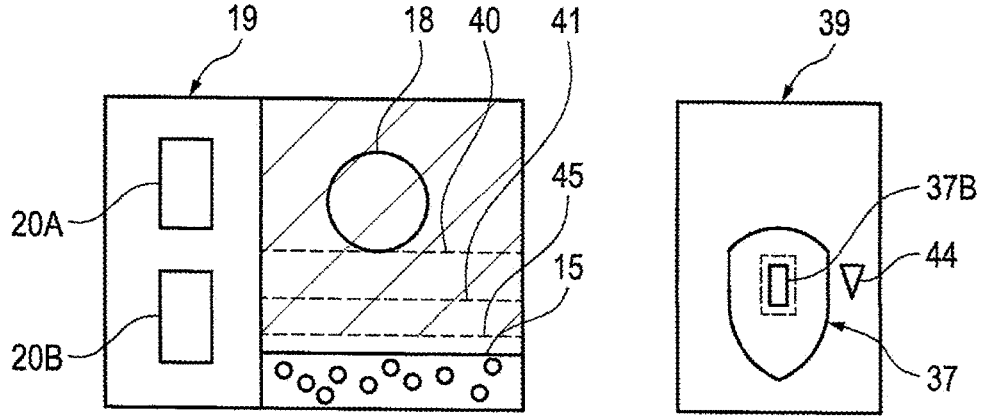
FIG. 7C is a diagram illustrating the visualization of a third instruction for adjusting the height of the milling/mixing roller relative to the ground surface.

The operation described above in general terms is explained using the following exemplary embodiment with reference to FIG. 7A to 7C, in which the individual parts are designated by the same reference numerals as in the preceding figures.

FIG. 7A shows, on the left side, the milling/mixing roller 18, which is height-adjustable relative to the machine frame 14 by means of the actuators 20A, 20B of the height adjustment device 19, which actuators in the present exemplary embodiment are the piston-cylinder arrangements 21, and, on the right side, the display 39 of the human-machine interface 26 with a graphic representation.

The operating states relevant for the lesson are the operating state of the internal combustion engine 24 and the operating state of the height adjustment device 19 of the milling/mixing roller 18. The current operating states are recorded by the state monitoring device 32. The state monitoring device 32 determines that the internal combustion engine 24 is not switched on and that the height of the lower edge 40 of the milling/mixing roller 18 relative to the ground surface 15 is less than a predetermined limit value 41. The height of the lower edge 40 of the milling/mixing roller 18 and the limit value 41 are indicated by dashed lines in FIG. 7A to 7C.

The controller 27 first checks whether the internal combustion engine 24 is switched on. Because the internal combustion engine 24 is not switched on, the controller 27 selects an instruction data set 1.0.1 from the instruction data sets 1.0.1, 1.0.2, 1.0.3 . . . and visualizes on the display 39 the instruction corresponding to the selected instruction data set, which instruction prompts the operator to actuate the switch or button 35 to switch on the combustion engine. This is done by displaying the pictogram shown in FIG. 7A, which shows the switch or button 35 for switching the internal combustion engine 24 on and off next to the joystick 37. The shape and arrangement of the button or switch and the joystick correspond in the graphic representation on the display 39 to its shape and arrangement on the human-machine interface 26 (control panel), so that the machine operator can see which switch is to be actuated. FIG. 7A shows such an animation only by way of example. Instead of a simplified graphic representation, the operating elements can also be shown realistically on the display. The operator can be encouraged to operate the switch or button 35, for example, by it flashing, which is illustrated in FIG. 7A by a circle 42 in a dashed line. However, if the engine is already switched on, this instruction data set will not be selected and displayed.

If the state monitoring device 32 detects that the internal combustion engine 24 is switched on and the height of the lower edge 40 of the milling/mixing roller 18 relative to the ground surface 15 is less than a predetermined limit value 41, the pictogram shown in FIG. 7B is displayed on the display 39, which pictogram, by means of the upward-pointing arrow 43 next to the flashing toggle switch 37B on the underside of the joystick 37, prompts to tilt said joystick upward in order to lift the milling/mixing roller 18. Because the milling/mixing roller is lifted, the roller cannot collide with the ground. Here, as in all the following figures, the representation of the pictogram is to be understood only as a means of indicating to the operator the operating element to be operated and how the operating element is to be operated.

FIG. 7C shows the case where the state monitoring device 32 detects that the internal combustion engine 24 is switched on and the height of the milling/mixing roller relative to the ground surface is greater than the predetermined limit value 41. The operator is prompted by the downward-pointing arrow 44 to tilt the toggle switch 37B downward, so that the milling/mixing roller 18 is lowered.

When lowering the milling/mixing roller 18, there is a risk that it may inadvertently penetrate the ground. Therefore, the controller 27 can provide for the definition of a specific operating range for the height of the milling/mixing roller 18 by means of a lower minimum limit value 45 for a minimum distance 45 to be maintained between the lower edge 40 of the milling/mixing roller 18 and the ground surface 15. In this case, the controller 27 generates the control command signals for the actuators 20A, 20B assigned to the milling/mixing roller 18 only when the milling/mixing roller is adjusted in height within the defined operating range, i.e., in the region marked by hatching in FIG. 7C above the lower minimum limit value 45, so that the minimum distance to the ground surface 15 is maintained. The milling/mixing roller 18 will therefore automatically stop its downward movement when the lower limit value 45 is reached. The operator can therefore practice the height adjustment of the milling/mixing roller 18 without any danger.

Figure 8A:
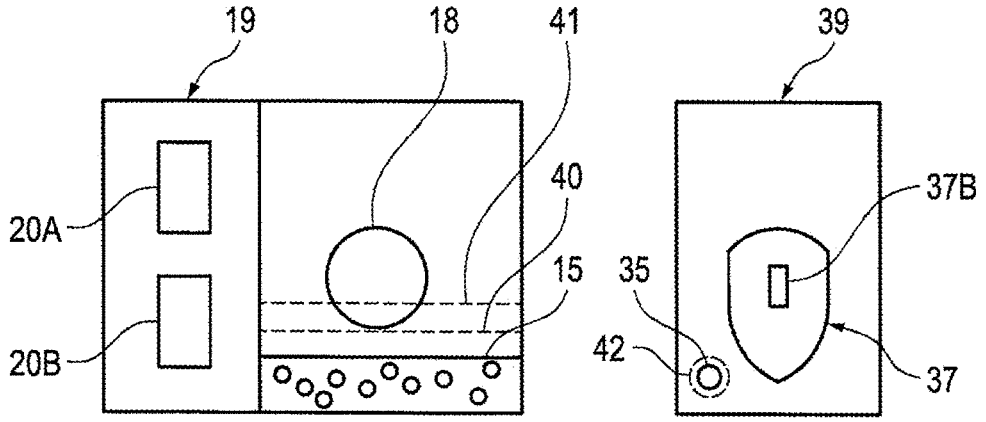
FIG. 8A is a diagram illustrating the visualization of a first instruction of a further exemplary embodiment for adjusting the height of the milling/mixing roller relative to the ground surface.
Figure 8B:
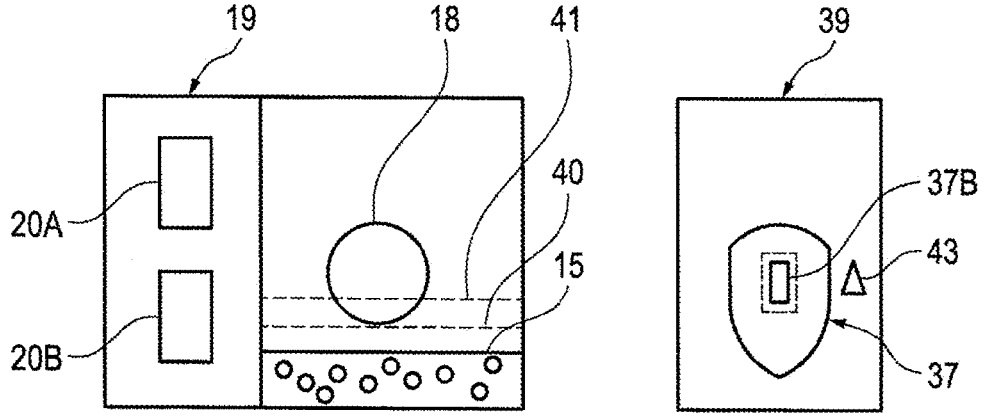
FIG. 8B is a diagram illustrating the visualization of a second instruction for adjusting the height of the milling/mixing roller relative to the ground surface.
Figure 8C:
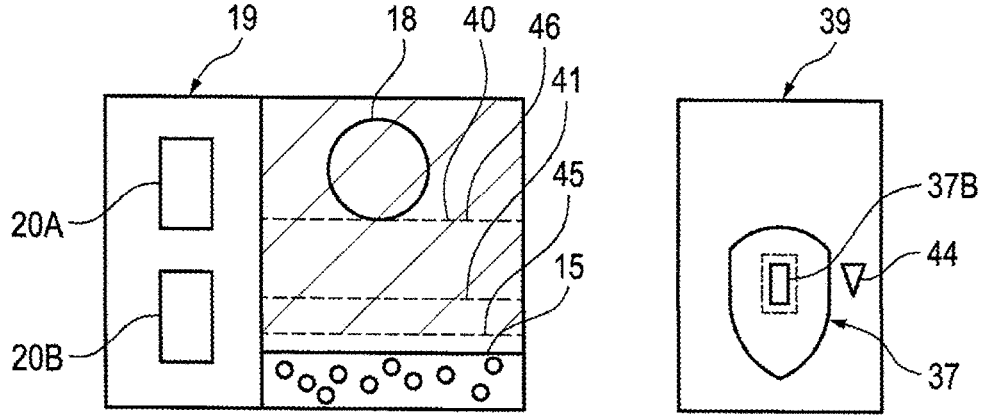
FIG. 8C is a diagram illustrating the visualization of a third instruction for adjusting the height of the milling/mixing roller relative to the ground surface.

FIG. 8A to 8C show a further exemplary embodiment in which the controller 27 is configured such that the operator is prompted to enter a plurality of commands one after the other. In a first step, the operator is prompted to switch on the internal combustion engine 24 (FIG. 8A), because the engine is not switched on. After the engine is switched on, the operator is prompted in a second step by the upward-pointing arrow 43 to lift the milling/mixing roller 18, because the height of the lower edge 40 of the milling/mixing roller 18 is less than a predetermined first (lower) limit value 41 (FIG. 8B). If the height of the lower edge 40 of the milling/mixing roller 18 is equal to a predetermined second (upper) limit value 46, the operator is then prompted in a third step by the downward-pointing arrow 44 to lower the milling/mixing roller 18 (FIG. 8C). The milling/mixing roller 18 stops its movement automatically when its lower edge 40 reaches the lower minimum limit value 45. After the lower limit value has been reached, the operator can be prompted to lift the milling/mixing roller 18 again. After the milling/mixing roller 18 has been lifted again, the operator can be prompted to lower the milling/mixing roller 18 again. These exercises can be repeated until the operator exits the learning mode. However, the learning mode can also be ended after a specific number of exercises. It can be seen that the controller 27 determines a specific sequence of command inputs, i.e., first raising and then lowering the milling/mixing roller, which sequence depends on the starting position of the milling/mixing roller, i.e., on the height of its lower edge 40.

Figure 9A:
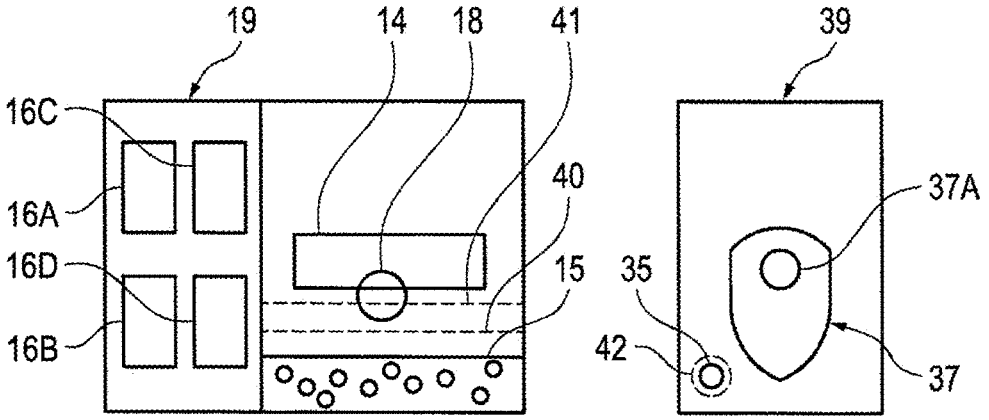
FIG. 9A is a diagram illustrating the visualization of a first instruction for adjusting the height of the machine frame relative to the ground surface.
Figure 9B:
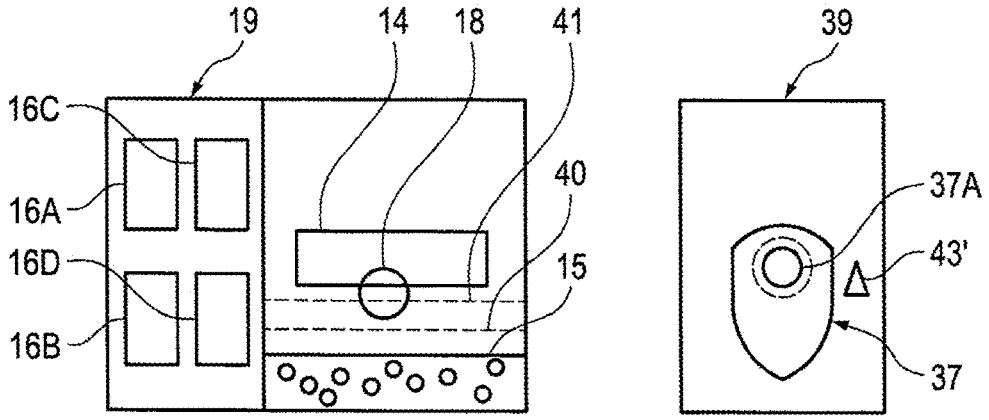
FIG. 9B is a diagram illustrating the visualization of a second instruction for adjusting the height of the machine frame relative to the ground surface.
Figure 9C:
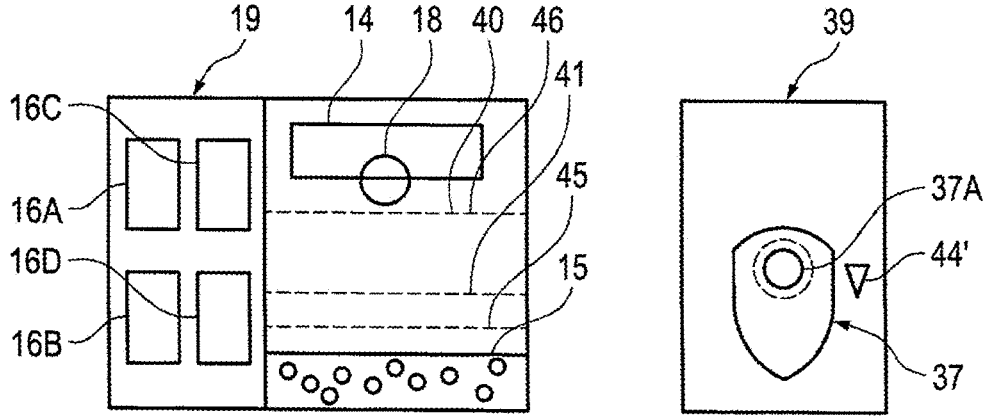
FIG. 9C is a diagram illustrating the visualization of a third instruction for adjusting the height of the machine frame relative to the ground surface.

A lesson of the learning mode for adjusting the height of the machine frame relative to the ground surface will be described below with reference to FIG. 9A to 9C, and a lesson of the learning mode for adjusting the transverse inclination of the machine frame by operating the actuators 16A, 16B, 16C, 16D associated with the front and rear, left and right lifting devices 10, 11, 12, 13 will be described with reference to FIG. 10A to 10C. In the figures, the machine frame 14 with the milling/mixing roller 18 is shown only schematically.

In a first step (FIG. 9A), the operator is prompted (as in FIGS. 7A and 8A) to switch on the internal combustion engine 24, because the engine is not switched on. After switching on the engine 24 by actuating the flashing switch or button 35, the operator is prompted in a second step by the flashing of the operating button 37A on the top of the joystick 37 to lift the machine frame 14 and thus the milling/mixing roller 18 arranged on the machine frame, because the height of the lower edge 40 of the milling/mixing roller 18 is less than a predetermined first (lower) limit value 41 (FIG. 9B). The upward pointing arrow 43' shows that the operating button 37A is to be tilted forward. When the height of the lower edge 40 of the milling/mixing roller 18 has reached a predetermined second (upper) limit value 46, the operator is prompted in a third step by the downward-pointing arrow 44' to lower the machine frame 14 (9C). The machine frame 14 stops its movement automatically when the lower edge 40 of the milling/mixing roller 18 has reached a lower minimum limit value. Once the lower limit value is reached, the operator can be prompted to lift the machine frame again. After the machine frame has been lifted again, the operator can be prompted to lower the machine frame again. These exercises can be repeated until the operator exits the learning mode. However, the learning mode can also be ended after a specific number of exercises.

The state monitoring device 32 is configured so as to detect the inclination of the machine frame 14 relative to the ground surface 15. If the state monitoring device 32 detects a tilt of the machine frame 14 to the left side (FIG. 10A), the operator is prompted in a first step by an arrow 47 pointing to the right to tilt the operating button 37A arranged on the top of the joystick 37 to the right, so that the machine frame 14 rolls to the right side. In a second step, the operator is then prompted by an arrow 48 pointing to the left to tilt the operating button 37A located on the top of the joystick to the left, so that the machine frame 14 rolls to the left side (FIG. 10B). In a third step, the operator can be prompted to roll the machine frame back to the right side (FIG. 10C).

Figure 10A:
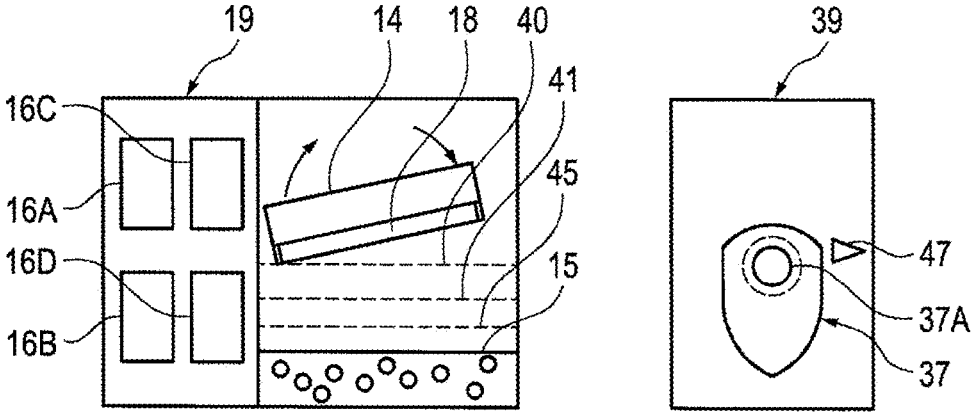
FIG. 10A is a diagram illustrating the visualization of a first instruction for adjusting the inclination of the machine frame relative to the ground surface.
Figure 10B:
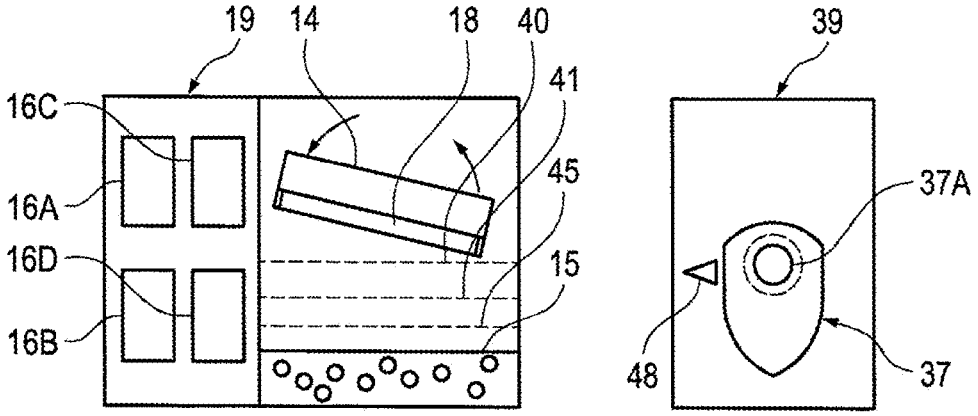
FIG. 10B is a diagram illustrating the visualization of a second instruction for adjusting the inclination of the machine frame relative to the ground surface.
Figure 10C:
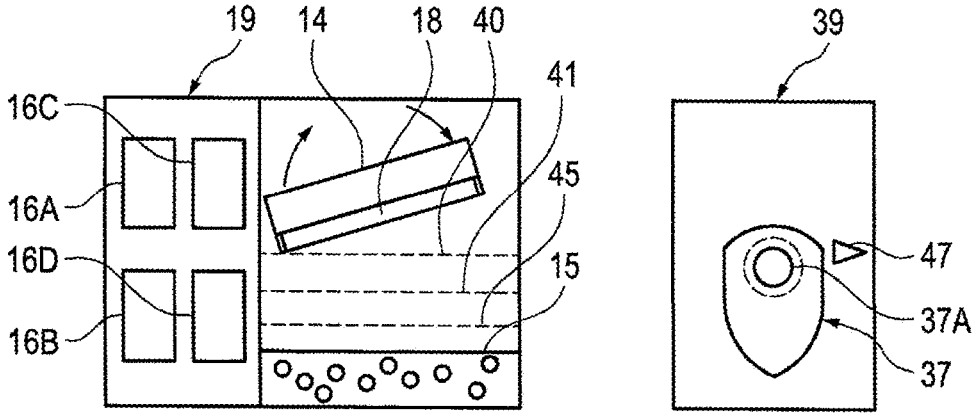
FIG. 10C is a diagram illustrating the visualization of a third instruction for adjusting the inclination of the machine frame relative to the ground surface.

The controller provides that control command signals for actuating the actuators 16A, 16B, 16C, 16D assigned to the lifting devices are only generated when the lower edge 40 of the milling/mixing roller is above the lower minimum limit value, i.e., the milling/mixing roller is within the defined operating range, which is the case in the exemplary embodiment of FIG. 10A to 10C (although greatly exaggerated). The operator can therefore also practice adjusting the height and inclination of the machine frame without any danger.

Figure 11A:
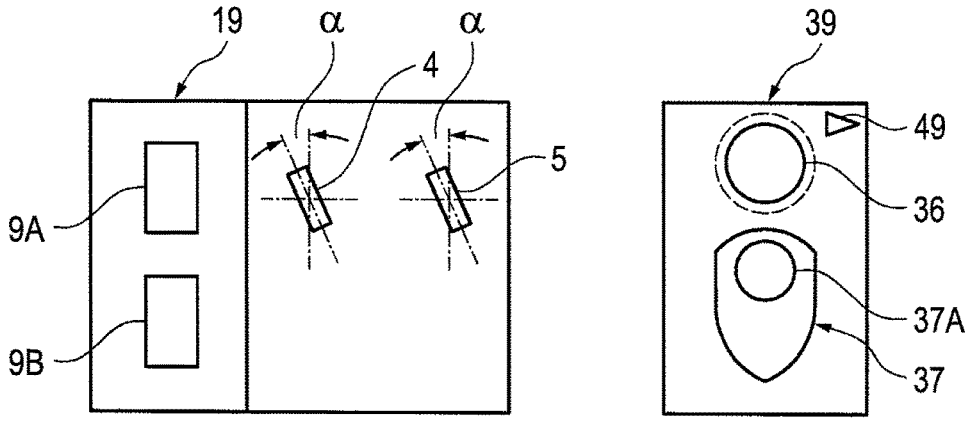
FIG. 11A is a diagram illustrating the visualization of a first instruction for adjusting the position of the front wheels.
Figure 11B:
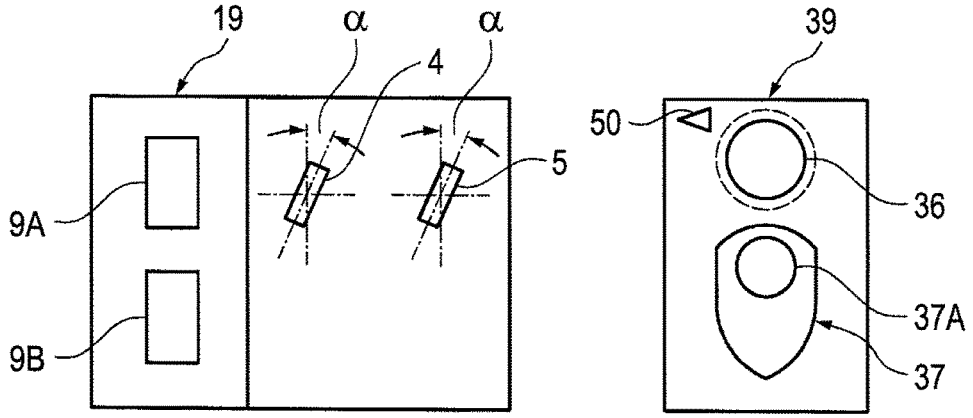
FIG. 11B is a diagram illustrating the visualization of a second instruction for adjusting the position of the front wheels.

A lesson of the learning mode for steering the front wheels 4, 5 will be described below with reference to FIG. 11A and FIG. 11B. The front wheels 4, 5 are shown only schematically in FIG. 11A and FIG. 11B. The steering angle is denoted by a.

The controller 27 provides that control command signals are generated for actuating the actuators 9A, 9B assigned to the front wheels 4, 5

The state monitoring device 32 is configured to detect the steering angle $\alpha$. If the state monitoring device 32 detects that the wheels 4, 5 are steered to the left, the operator is prompted to turn the steering wheel by the flashing of an icon depicting the steering wheel 36, which is again illustrated by a circle in FIG. 11A to 11C. The direction in which the steering wheel 36 is to be turned can be indicated by an arrow 49 pointing to the right (FIG. 11A). If, however, the wheels are steered to the right, the operator is prompted to turn the steering wheel 36 to the left (FIG. 11B), which is signaled by an arrow 50 pointing to the left. The prompt to turn the steering wheel 36 therefore depends on the initial position of the wheels 4, 5. When turning the steering wheel 36, the operator can see how the front wheels are steering by looking at the wheels. The position of the wheels can also be visualized on the display 39.

Figure 11C:
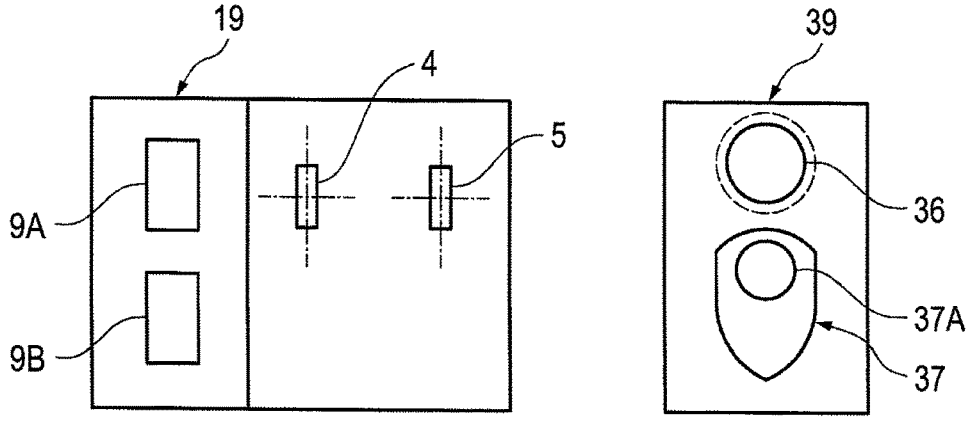
FIG. 11C is a diagram illustrating the visualization of a third instruction for adjusting the position of the front wheels.

FIG. 11C shows an exemplary embodiment in which the controller selects an instruction data set in order to display a corresponding pictogram on the display 39 of the human-machine interface 26, which pictogram prompts the operator to steer the front wheels 4, 5 straight ahead by turning the steering wheel 36 when the state monitoring device 32 determines that the front wheels 4, 5 are steered to the left or right. The wheels can also be straightened by pressing a separate button, after which the wheels will straighten automatically.

A further embodiment provides that the state monitoring device 32 monitors both the steering angle $\alpha$ of the front wheels 4, 5 in the working direction 3 and the rear wheels 6, 7, to which the actuators 9A, 9B, 9C, 9D are assigned for actuating said wheels. In this embodiment, the controller 27 provides for the setting of different operating modes, which are different steering modes. The state monitoring device 32 is configured such that the set steering mode is also detected.

Figure 12A:
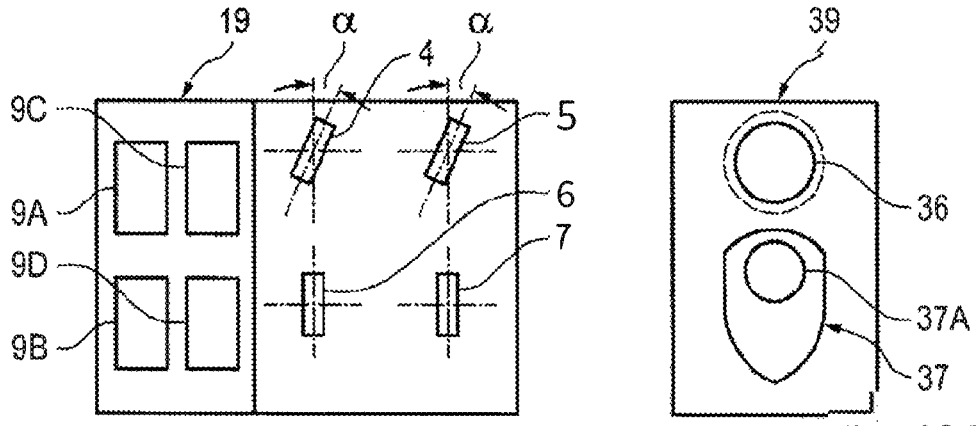
FIG. 12A is a diagram illustrating the visualization of an instruction for adjusting the position of the wheels in a steering mode of "front wheel steering,"

FIG. 12A shows the case where the steering mode "front wheel steering" is set. If the state monitoring device 32 detects the steering mode "front wheel steering," the controller 27 selects an instruction data set in order to display a corresponding pictogram on the display of the human-machine interface, which pictogram prompts the operator to steer the front wheels 4, 5, for example by the flashing of the steering wheel 36 on the display 39. This may be a prompt to steer left and/or right and/or straight ahead, as illustrated in FIG. 11A, 11B or 11C. The controller 27 can select the relevant data records in a predetermined order. The operator is thus shown that the front wheels 4, 5 are steered with the steering wheel 36 and not with the joystick 37. When turning the steering wheel 36, the operator can then see by looking at the wheels 4, 5, 6, 7 and/or at the display 39 that only the front wheels 4, 5 are steering.

Figure 12B:
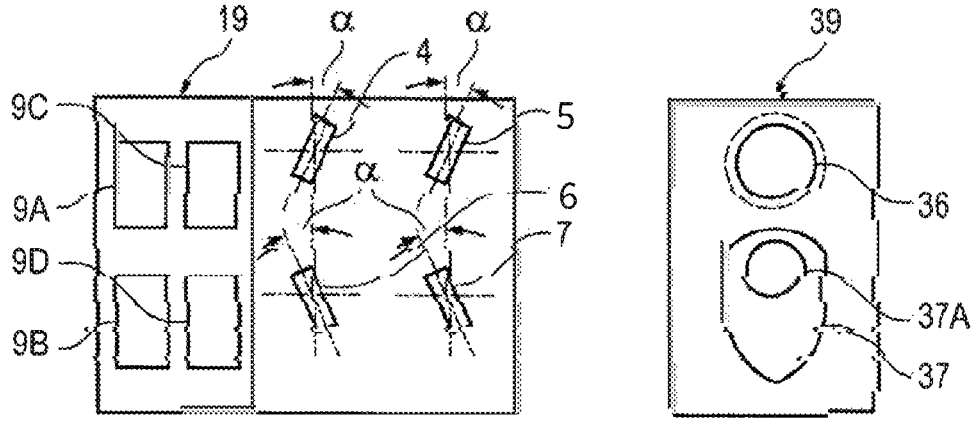
FIG. 12B is a diagram illustrating the visualization of an instruction for adjusting the position of the wheels in a steering mode of "front wheel and rear wheel steering" in opposite directions.

FIG. 12B shows the case where the steering mode "all-wheel steering" is set, in which both the front and rear wheels 4, 5, 6, 7 are steered in opposite directions. If the state monitoring device 32 detects the set steering mode "all-wheel steering," the controller 27 selects an instruction data set in order to display a corresponding pictogram on the display 39 of the human-machine interface 26, which pictogram prompts the operator to turn the steering wheel 36 in one direction or the other, for example by the flashing of the steering wheel 36 on the display 39. The operator is thus shown that all wheels 4, 5, 6, 7 can be steered in opposite directions using the steering wheel 36. When turning the steering wheel 36, the operator can see by looking at the wheels and/or the display 39 that the front and rear wheels 4, 5, 6, 7 are moving in opposite directions.

Figure 12C:
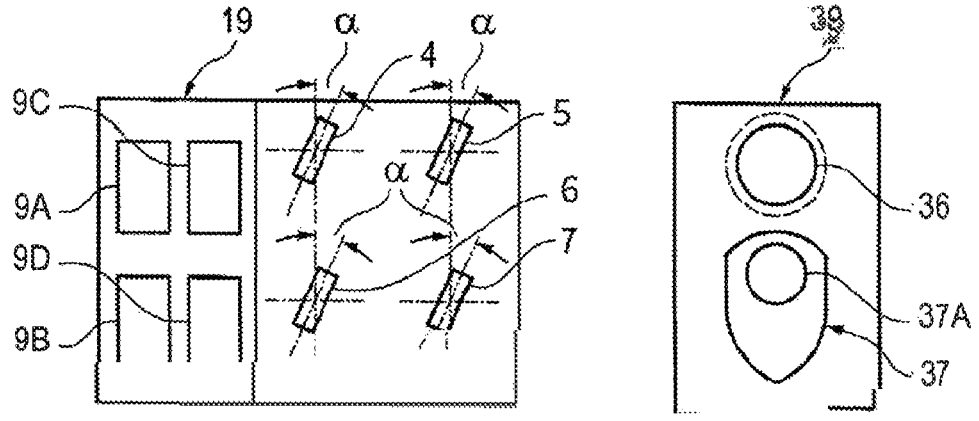
FIG. 12C is a diagram illustrating the visualization of an instruction for adjusting the position of the wheels in a steering mode of "front wheel and rear wheel steering" in the same direction.

FIG. 12C shows the case where the steering mode "crab steering" is set, in which the front and rear wheels 4, 5, 6, 7 are steered in the same direction. If the state monitoring device 32 detects the set steering mode "crab steering," the controller 27 selects an instruction data set in order to display a corresponding pictogram on the display 39 of the human-machine interface 26, which pictogram prompts the operator to turn the steering wheel, for example by the flashing of an icon depicting the steering wheel 36. This shows the operator that the steering wheel is steering all wheels in the same direction. When turning the steering wheel 36, the operator can immediately see by looking at the wheels and/or the display 39 that the front and rear wheels are moving in the same direction.

Figure 12D:
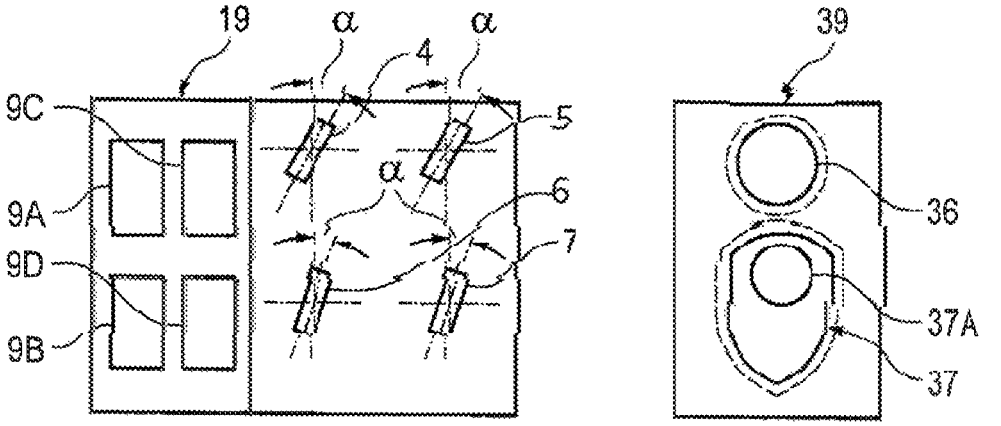
FIG. 12D is a diagram illustrating the visualization of a first instruction for adjusting the position of the wheels in a steering mode in which the front wheels are steered independently of the rear wheels.

FIG. 12D shows the case where a steering mode is predetermined in which the front and rear wheels 4, 5, 6, 7 can be moved independently of one another. When the state monitoring device 32 detects this steering mode, the controller 27 selects an instruction data set to display a corresponding pictogram on the display 39 of the human-machine interface 26, which pictogram prompts the operator to turn the steering wheel 36 and to pivot the joystick 37 to the left or right, for example via the flashing via the flashing of an icon depicting the steering wheel 36 and the joystick 37, which is again illustrated by a circle in FIG. 12D. The operator can also be prompted to do this by an animation that encourages them to turn the steering wheel and swing the joystick in one direction or the other. By looking at the wheels 4, 5, 6, 7 and/or the display 39, the operator can immediately see the corresponding movement of the front wheels 4, 5 when turning the steering wheel 36 and the corresponding movement of the rear wheels when pivoting the joystick 37.

What is claimed is:

1. A self-propelled road construction machine comprising:

a machine frame carried by drivable, steerable wheels or crawler tracks;

a milling/mixing roller for working the ground and that is arranged on the machine frame;

one or more drives and/or actuators associated with the wheels or crawler tracks and the milling/mixing roller for driving and steering the wheels or crawler tracks and adjusting a height of the milling/mixing roller relative to a surface of a ground to be worked;

a controller configured to generate control command signals for the one or more drives and/or actuators in order to drive and steer the wheels or crawler tracks and to adjust the height of the milling/mixing roller;

a human-machine interface interacting with the controller;

a memory device interacting with the controller, and comprising stored therein a plurality of instruction data sets, each of which contains data for an instruction to be visualized using the human-machine interface for input of a command by a user with the human-machine interface for adjusting a position of the wheels or crawler tracks and/or the height of the milling/mixing roller; and a state monitoring device interacting with the controller and configured to detect an operating state and/or an operating mode of the one or more drives and/or actuators;

wherein the controller provides a learning mode comprising a plurality of lessons for an adjustment of the position of the wheels or crawler tracks and/or the height of the milling/mixing roller by the user, wherein the controller is configured for at least one lesson of the learning mode such that, depending on an operating state and/or operating mode of the one or more drives and/or actuators detected by the state monitoring device, a selection of a specific instruction data set from the plurality of instruction data sets is made, and the instruction corresponding to the selected specific instruction data set is visualized using the human-machine interface, and depending on the command input by the user with the human-machine interface after the visualization of the instruction, one or more control command signals corresponding to the command input are generated for the one or more drives and/or actuators for driving and steering the wheels or crawler tracks and/or for adjusting the height of the milling/mixing roller.

2. The self-propelled road construction machine of claim 1, wherein:

a lesson of the learning mode relates to adjustment of the height of the milling/mixing roller relative to the surface of the ground to be worked; and the controller for this lesson of the learning mode is configured such that, if the height of the milling/mixing roller relative to the ground surface detected by the state monitoring device is less than a limit value for the height, an instruction data set is selected from the plurality of instruction data sets stored in the memory device and the instruction corresponding to the selected instruction data set is visualized using the human-machine interface, which instruction prompts a user to enter a command to raise the milling/mixing roller, so that after the command is entered at least one actuator assigned to the milling/mixing roller is actuated such that the milling/mixing roller is raised, or if the height of the milling/mixing roller relative to the ground surface detected by the state monitoring device is greater than a limit value for the height, an instruction data set is selected from the plurality of instruction data sets and the instruction corresponding to the selected instruction data set is visualized using the human-machine interface, which instruction prompts a user to enter a command to lower the milling/mixing roller, so that after the command is entered at least one actuator assigned to the milling/mixing roller is actuated such that the milling/mixing roller is lowered.

3. The self-propelled road construction machine of claim 2, wherein the controller for the lesson of the learning mode is configured such that:

a specific operating range for the height of the milling/mixing roller is defined by a limit value for a minimum distance to be maintained from a reference point of the milling/mixing roller to the surface of the ground to be worked, and, depending on a command entered by a user for lowering the milling/mixing roller after the visualization of the instruction, the control command signals corresponding to the command entered for the at least one actuator assigned to the milling/mixing roller are only generated when the milling/mixing roller is adjusted in height within the specific operating range, so that the minimum distance to the ground surface is maintained.

4. The self-propelled road construction machine of claim 2, wherein the controller for the lesson of the learning mode is configured such that, if the height of the milling/mixing roller relative to the ground surface detected by the state monitoring device is less than a limit value for the height:

for a preceding instruction with respect to the lesson of the learning mode an instruction data set is selected from the plurality of instruction data sets and the instruction corresponding to the selected instruction data set is visualized using the human-machine interface, which instruction prompts a user to enter a command to raise the milling/mixing roller, so that after the command is entered at least one actuator assigned to the milling/mixing roller is actuated such that the milling/mixing roller is raised; and the controller is configured such that a data set is selected from the plurality of instruction data sets for an instruction following the preceding instruction and the instruction corresponding to the selected instruction data set is visualized using the human-machine interface, which instruction prompts a user to enter a command to lower the milling/mixing roller, so that after the command is entered at least one actuator assigned to the milling/mixing roller is actuated such that the milling/mixing roller is lowered, wherein a specific operating range for the height of the milling/mixing roller is defined by a limit value for a minimum distance to be maintained from a reference point of the milling/mixing roller to the surface of the ground to be worked, and, depending on a command entered by a user for lowering the milling/mixing roller after the visualization of the instruction, the control command signals corresponding to the command entered for the at least one actuator assigned to the milling/mixing roller can only be generated when the milling/mixing roller is adjusted in height within the specific operating range, so that the minimum distance to the ground surface is maintained.

5. The self-propelled road construction machine of claim 1, wherein:

the machine frame is carried by left lifting devices associated with left wheels or crawler tracks in a working direction and right lifting devices associated with right wheels or crawler tracks in the working direction;

one or more actuators are provided for actuating the left and right lifting devices, so that the height of the machine frame and the milling/mixing roller arranged on the machine frame can be adjusted relative to the surface of the ground to be worked by actuating the one or more actuators assigned to the left and right lifting devices; and a lesson of the learning mode relates to adjustment of the height of the machine frame relative to the surface of the ground to be worked, wherein the controller is configured for this lesson of the learning mode such that, if the height of the milling/mixing roller relative to the ground surface detected by the state monitoring device is less than a limit value for the height, an instruction data set is selected from the plurality of instruction data sets stored in the memory device and the instruction corresponding to the selected instruction data set is visualized using the human-machine interface, which instruction prompts a user to enter a command to raise the machine frame, so that after the command is entered actuators assigned to the left and right lifting devices are actuated such that the machine frame is raised, or if the height of the milling/mixing roller relative to the ground surface detected by the state monitoring device is greater than a limit value for the height, an instruction data set is selected from the plurality of instruction data sets and the instruction corresponding to the selected instruction data set is visualized using the human-machine interface, which instruction prompts a user to enter a command to lower the machine frame, so that after the command is entered actuators assigned to the left and right lifting devices are actuated such that the machine frame is lowered.

6. The self-propelled road construction machine of claim 5, wherein the controller for this lesson of the learning mode is configured such that a specific operating range for the height of the milling/mixing roller is defined by a limit value for a minimum distance to be maintained from a reference point of the milling/mixing roller to the surface of the ground to be worked and, depending on the command entered by a user after the visualization of the instruction, the control command signals corresponding to the command entered for the one or more actuators assigned to the left and right lifting devices are only generated when the milling/mixing roller is adjusted in height within the specific operating range, so that the minimum distance to the ground surface is maintained.

7. The self-propelled road construction machine of claim 1, wherein a lesson of the learning mode relates to adjustment of a transverse inclination of the machine frame, wherein the controller for this lesson of the learning mode is configured such that, if a transverse inclination of the machine frame detected by the state monitoring device is an inclination to a right side, an instruction data set is selected from the plurality of instruction data sets stored in the memory device and the instruction corresponding to the selected instruction data set is visualized using the human-machine interface, which instruction prompts a user to enter a command to roll the machine frame to a left side of the self-propelled road construction machine in a working direction, so that after the command is entered the actuators assigned to lifting devices on the left side in the working direction are actuated such that the machine frame is lowered on the left side, and/or the actuators assigned to lifting devices on the right side in the working direction are actuated such that the machine frame is raised on the right side, or if the transverse inclination of the machine frame detected by the state monitoring device is an inclination to the left side, an instruction data set is selected from the plurality of instruction data sets and the instruction corresponding to the selected instruction data set is visualized using the human-machine interface, which instruction prompts a user to enter a command to roll the machine frame to the right side of the self-propelled road construction machine in a working direction, so that after the command is entered the actuators assigned to the lifting devices on the right side in the working direction are actuated such that the machine frame is lowered on the right side, and/or the actuators assigned to the lifting devices on the left side in the working direction are actuated such that the machine frame is raised on the left side.

8. The self-propelled road construction machine of claim 7, wherein the controller for this lesson of the learning mode is configured such that a specific operating range for the height of the milling/mixing roller is defined by a limit value for a minimum distance to be maintained from a reference point of the milling/mixing roller to the surface of the ground to be worked and, depending on the command entered by a user after the visualization of the instruction, the control command signals corresponding to the command entered for the actuators assigned to the lifting devices are only generated when the milling/mixing roller is adjusted in height within the specific operating range, so that the minimum distance to the ground surface is maintained.

9. The self-propelled road construction machine of claim 1, wherein a lesson of the learning mode relates to steering of the wheels or running gear, wherein the controller for this lesson of the learning mode is configured such that, if the position of the wheels or crawler tracks detected by the state monitoring device is a position of the wheels or crawler tracks turned to the right, an instruction data set is selected from the plurality of instruction data sets stored by the memory device and the instruction corresponding to the selected instruction data set is visualized using the human-machine interface, which instruction prompts a user to enter a command to steer front wheels or crawler tracks to the left in a working direction, so that after the command is entered actuators assigned to the front wheels or crawler tracks are actuated such that the front wheels turn to the left, or if the position of the wheels or crawler tracks detected by the state monitoring device is a position of the wheels or crawler tracks turned to the left, an instruction data set is selected from the plurality of instruction data sets and the instruction corresponding to the selected instruction data set is visualized using the human-machine interface, which instruction prompts a user to enter a command to steer the front wheels or crawler tracks to the right in the working direction, so that after the command is entered the actuators assigned to the wheels or crawler tracks are actuated such that the front wheels turn to the right, or if the position of the wheels or crawler tracks detected by the state monitoring device is a position turned to the right or left, an instruction data set is selected from the plurality of instruction data sets stored by the memory device and the instruction corresponding to the selected instruction data set is visualized using the human-machine interface, which instruction prompts a user to position the front wheels straight ahead in the working direction, so that after the command is entered the actuators assigned to the front wheels or crawler tracks are actuated such that the front wheels are positioned straight ahead in the working direction.

10. The self-propelled road construction machine of claim 1, wherein the self-propelled road construction machine has two front wheels or crawler tracks in a working direction and two rear wheels or crawler tracks in the working direction and the controller provides for the setting of different steering modes and the state monitoring device is configured such that the position of the front and rear wheels or crawler tracks and a set steering mode are detected; and wherein:

if the steering mode detected by the state monitoring device is steering only of the front wheels or crawler tracks, an instruction data set is selected from the plurality of instruction data sets stored in the memory device and the instruction corresponding to the selected instruction data set is visualized using the human-machine interface, which instruction prompts a user to steer only the front wheels or crawler tracks, so that after a command is entered actuators assigned to the front wheels or crawler tracks are actuated such that only the front wheels or crawler tracks are steered, or if the steering mode detected by the state monitoring device is steering of the front and rear wheels or crawler tracks in opposite directions, an instruction data set is selected from the plurality of instruction data sets and the instruction corresponding to the selected instruction data set is visualized using the human-machine interface, which instruction prompts a user to steer both the front and rear wheels or crawler tracks in opposite directions, so that after a command is entered actuators assigned to the wheels or crawler tracks are actuated such that the front and rear wheels or crawler tracks are steered in opposite directions, or if the steering mode detected by the state monitoring device is steering of the front and rear wheels or crawler tracks in the same direction, an instruction data set is selected from the plurality of instruction data sets and the instruction corresponding to the selected instruction data set is visualized using the human-machine interface, which instruction prompts a user to steer both the front and rear wheels or crawler tracks in the same direction, so that after a command is entered actuators assigned to the wheels or crawler tracks are actuated such that the front and rear wheels or crawler tracks are steered, or if the steering mode detected by the state monitoring device is steering of the front and rear wheels or crawler tracks independently of one another, an instruction data set is selected from the plurality of instruction data sets and the instruction corresponding to the selected instruction data set is visualized using the human-machine interface, which instruction prompts a user to steer the front and rear wheels or crawler tracks independently of one another, so that after a command is entered actuators assigned to the front and rear wheels or crawler tracks are actuated such that the front and rear wheels or crawler tracks are steered independently of one another.

11. The self-propelled road construction machine of claim 10, wherein the human-machine interface comprises an operating element for entering commands for adjusting the height and inclination of the machine frame relative to the ground to be worked, which is configured such that the operating element can assume any one of a neutral position, a first position, a second position, a third position, and a fourth position, wherein, when the operating element is in the neutral position, the controller is configured such that no control command signals are generated for actuators assigned to front and rear lifting devices on the left and right in the working direction, so that the front and rear lifting devices on the left and right in the working direction remain in a currently set position, when the operating element is in the first position, the controller for lifting the machine frame is configured such that control command signals are generated for the actuators assigned to the front and rear lifting devices on the left and right in the working direction, so that the front and rear lifting devices on the left and right in the working direction are raised, when the operating element is in the second position, the controller for lowering the machine frame is configured such that control command signals are generated for the actuators assigned to the front and rear lifting devices on the left and right in the working direction, so that the front and rear lifting devices on the left and right in the working direction are lowered, when the operating element is in the third position, the controller for rolling the machine frame to the left side in the working direction is configured such that control command signals are generated for the actuators assigned to the front and rear lifting devices on the left and right in the working direction, so that the front and rear lifting devices on the left in the working direction are lowered and the front and rear lifting devices on the right in the working direction are lifted, and when the operating element is in the fourth position, the controller for rolling the machine frame to the right side in the working direction is configured such that control command signals are generated for the actuators assigned to the front and rear lifting devices on the left and right in the working direction, so that the front and rear lifting devices on the left in the working direction are lifted and the front and rear lifting devices on the right in the working direction are lowered.

12. The self-propelled road construction machine of claim 1, wherein the human-machine interface for entering commands for adjusting the height of the milling/mixing roller relative to the machine frame comprises an operating element which is configured such that the operating element can assume any one of a neutral position, a first position, and a second position, wherein, when the operating element is in the neutral position, the controller is configured such that no control command signals are generated for at least one actuator assigned to the milling/mixing roller, so that the milling/mixing roller remains in a currently set position, when the operating element is in the first position, the controller is configured such that control command signals are generated for the at least one actuator assigned to the milling/mixing roller, so that the milling/mixing roller is lifted, and when the operating element is in the second position, the controller is configured such that control command signals are generated for the at least one actuator assigned to the milling/mixing roller, so that the milling/mixing roller is lowered.

13. The self-propelled road construction machine of claim 1, wherein the human-machine interface for entering commands:

for steering only front wheels or crawler tracks, front and rear wheels or crawler tracks in the same direction, or the front and rear wheels or crawler tracks in opposite directions, has an operating element configured as a steering wheel; and for steering the front and rear wheels or crawler tracks independently of one another, has an operating element configured as a steering wheel for steering the front wheels or crawler tracks and an operating element configured as a joystick for steering the rear wheels or crawler tracks.

14. The self-propelled road construction machine of claim 1, wherein:

the one or more drives and/or actuators comprise one or more hydraulic drives or hydraulic actuators;

the self-propelled road construction machine has a drive engine for driving at least one hydraulic pump for supplying the one or more drives and/or actuators with hydraulic fluid;

the state monitoring device is configured such that an operation of the drive engine is detected; and the controller is configured such that, if the state monitoring device does not detect the operation of the drive engine, an instruction data set is selected from the plurality of instruction data sets and the instruction corresponding to the selected instruction data set is visualized using the human-machine interface, which instruction prompts a user to enter a command to switch on the drive engine, so that the drive engine is switched on.

15. The self-propelled road construction machine of claim 1, wherein the human-machine interface for visualizing instruction data sets for prompting a user to enter commands has a display on which the visualization of the instruction data sets takes place with graphic representations, in particular pictograms.

16. A method of operating a self-propelled road construction machine comprising a machine frame supported by wheels or crawler tracks, a milling/mixing roller arranged on the machine frame, one or more drives and/or actuators associated with the wheels or crawler tracks and the milling/mixing roller for driving and steering the wheels or crawler tracks and adjusting a height of the milling/mixing roller relative to a surface of a ground to be worked, a human-machine interface, a controller, and a memory device having stored therein a plurality of instruction data sets, each of which contains data for an instruction to be visualized via the human-machine interface for user input commanding adjustment of a position of the wheels or crawler tracks and/or the height of the milling/mixing roller, the method comprising:

detecting an operating state and/or an operating mode of the one or more drives and/or actuators;

for at least one lesson in a learning mode associated with the controller, the learning mode comprising a plurality of lessons for the adjustment of the position of the wheels or crawler tracks and/or the height of the milling/mixing roller by the user:

dependent on the detected operating state and/or operating mode, selecting a specific instruction data set from the plurality of instruction data sets;

visualizing the instruction corresponding to the selected specific instruction data set via the human-machine interface;

determining a command input received via the human-machine interface after the visualization of the instruction; and generating one or more control command signals corresponding to the command input for the one or more drives and/or actuators for driving and steering the wheels or crawler tracks and/or for adjusting the height of the milling/mixing roller.

17. The method of claim 16, wherein a first lesson of the learning mode relates to adjustment of the height of the milling/mixing roller relative to the surface of the ground to be worked, wherein in association with the first lesson:

if the height of the milling/mixing roller relative to the ground surface detected by a state monitoring device is less than a limit value for the height, an instruction data set is selected from the plurality of instruction data sets stored in the memory device and the instruction corresponding to the selected instruction data set is visualized using the human-machine interface, which instruction prompts a user to enter a command to raise the milling/mixing roller, so that after the command is entered at least one actuator assigned to the milling/mixing roller is actuated such that the milling/mixing roller is raised, or if the height of the milling/mixing roller relative to the ground surface detected by the state monitoring device is greater than a limit value for the height, an instruction data set is selected from the plurality of instruction data sets and the instruction corresponding to the selected instruction data set is visualized using the human-machine interface, which instruction prompts a user to enter a command to lower the milling/mixing roller, so that after the command is entered at least one actuator assigned to the milling/mixing roller is actuated such that the milling/mixing roller is lowered.

18. The method of claim 17, wherein in association with the first lesson:

a specific operating range for the height of the milling/mixing roller is defined by a limit value for a minimum distance to be maintained from a reference point of the milling/mixing roller to the surface of the ground to be worked, and, depending on a command entered by a user for lowering the milling/mixing roller after the visualization of the instruction, control command signals corresponding to the command entered for the at least one actuator assigned to the milling/mixing roller are only generated when the milling/mixing roller is adjusted in height within the specific operating range, so that the minimum distance to the ground surface is maintained.

19. The method of claim 17, wherein in association with the first lesson, if the height of the milling/mixing roller relative to the ground surface detected by the state monitoring device is less than a limit value for the height:

for a preceding instruction with respect to the first lesson of the learning mode an instruction data set is selected from the plurality of instruction data sets and the instruction corresponding to the selected instruction data set is visualized using the human-machine interface, which instruction prompts a user to enter a command to raise the milling/mixing roller, so that after the command is entered at least one actuator assigned to the milling/mixing roller is actuated such that the milling/mixing roller is raised; and a data set is selected from the plurality of instruction data sets for an instruction following the preceding instruction and the instruction corresponding to the selected instruction data set is visualized using the human-machine interface, which instruction prompts a user to enter a command to lower the milling/mixing roller, so that after the command is entered at least one actuator assigned to the milling/mixing roller is actuated such that the milling/mixing roller is lowered, wherein a specific operating range for the height of the milling/mixing roller is defined by a limit value for a minimum distance to be maintained from a reference point of the milling/mixing roller to the surface of the ground to be worked, and, depending on a command entered by a user for lowering the milling/mixing roller after the visualization of the instruction, control command signals corresponding to the command entered for the at least one actuator assigned to the milling/mixing roller can only be generated when the milling/mixing roller is adjusted in height within the specific operating range, so that the minimum distance to the ground surface is maintained.

20. The method of claim 16, wherein the self-propelled road construction machine has two front wheels or crawler tracks in a working direction and two rear wheels or crawler tracks in the working direction, the controller provides for the setting of different steering modes, and the position of the front and rear wheels or crawler tracks and a set steering mode are detected; and wherein:

if the detected steering mode is steering only of the front wheels or crawler tracks, an instruction data set is selected from the plurality of instruction data sets stored in the memory device and the instruction corresponding to the selected instruction data set is visualized using the human-machine interface, which instruction prompts a user to steer only the front wheels or crawler tracks, so that after a command is entered actuators assigned to the front wheels or crawler tracks are actuated such that only the front wheels or crawler tracks are steered, or if the detected steering mode is steering of the front and rear wheels or crawler tracks in opposite directions, an instruction data set is selected from the plurality of instruction data sets and the instruction corresponding to the selected instruction data set is visualized using the human-machine interface, which instruction prompts a user to steer both the front and rear wheels or crawler tracks in opposite directions, so that after a command is entered actuators assigned to the wheels or crawler tracks are actuated such that the front and rear wheels or crawler tracks are steered in opposite directions, or if the detected steering mode is steering of the front and rear wheels or crawler tracks in the same direction, an instruction data set is selected from the plurality of instruction data sets and the instruction corresponding to the selected instruction data set is visualized using the human-machine interface, which instruction prompts a user to steer both the front and rear wheels or crawler tracks in the same direction, so that after a command is entered actuators assigned to the wheels or crawler tracks are actuated such that the front and rear wheels or crawler tracks are steered, or if the detected steering mode is steering of the front and rear wheels or crawler tracks independently of one another, an instruction data set is selected from the plurality of instruction data sets and the instruction corresponding to the selected instruction data set is visualized using the human-machine interface, which instruction prompts a user to steer the front and rear wheels or crawler tracks independently of one another, so that after a command is entered actuators assigned to the front and rear wheels or crawler tracks are actuated such that the front and rear wheels or crawler tracks are steered independently of one another.

* * * * *